US007647932B2

(12) United States Patent
Cantrell et al.

(10) Patent No.: US 7,647,932 B2
(45) Date of Patent: Jan. 19, 2010

(54) SMOKING ARTICLE

(75) Inventors: Daniel V. Cantrell, Lewisville, NC (US); William J. Casey, III, Clemmons, NC (US); Evon L. Crooks, Mocksville, NC (US); Billy T. Conner, Clemmons, NC (US); Joanne N. Taylor, Germanton, NC (US); Jeffrey A. Willis, Germanton, NC (US); Dempsey B. Brewer, Jr., East Bend, NC (US); Wayne E. Davis, Jr., East Bend, NC (US); James R. Stone, Advance, NC (US)

(73) Assignee: R.J. Reynolds Tobacco Company, Winston-Salem, NC (US)

( * ) Notice: Subject to any disclaimer, the term of this patent is extended or adjusted under 35 U.S.C. 154(b) by 531 days.

(21) Appl. No.: 11/194,215

(22) Filed: Aug. 1, 2005

(65) Prior Publication Data

US 2007/0023056 A1 Feb. 1, 2007

(51) Int. Cl.
*A24D 3/06* (2006.01)
*A24D 3/04* (2006.01)
*A24B 1/00* (2006.01)

(52) U.S. Cl. ..... 131/342; 131/335; 131/341; 131/344; 131/360

(58) Field of Classification Search ..... 131/360, 131/365, 190, 194, 335, 339, 341–342, 344
See application file for complete search history.

(56) References Cited

U.S. PATENT DOCUMENTS 4,347,855 A 9/1982 Lanzillotti et al.

(Continued)

FOREIGN PATENT DOCUMENTS

EP 174645 * 3/1986

(Continued)

*Primary Examiner*—Eric Hug
*Assistant Examiner*—Jodi Cohen
(74) *Attorney, Agent, or Firm*—Brinks Hofer Gilson & Lione

(57) ABSTRACT

A smoking article, such as a cigarette, includes a lighting end and a mouth end. The lighting end is a longitudinally extending segment comprising smokable material that is intended to be lit and burned, and the resulting smoke generated by the burning of that smokable material is intended to be drawn into the mouth of the smoker through the mouth end of smoking article. A mouth end piece is located at the mouth end of the smoking article, and the mouth end piece allows the smoking article to be placed in the mouth of the smoker to be drawn upon. The smoking article further incorporates an aerosol-generation system that is located between the lighting end segment and the mouth end piece. The aerosol-generation system includes (i) a heat generation segment located adjacent to the lighting end segment, and (ii) an aerosol-generation region located between the heat generation segment and the mouth end piece. The aerosol-generation region incorporates an aerosol-forming material (e.g., glycerin and flavors). The lighting end segment is in a heat exchange relationship with the heat generation segment such that burning smokable material within the lighting end segment can ignite a combustible fuel element of the heat generation segment. The heat generation segment is in a heat exchange relationship with the aerosol-generation region such that heat generated by the burning fuel element acts to volatilize aerosol-forming material for aerosol formation.

20 Claims, 3 Drawing Sheets

U.S. PATENT DOCUMENTS

| | | | | | |
|---|---|---|---|---|---|
| 4,714,082 | A | | 12/1987 | Banerjee et al. | |
| 4,771,795 | A | | 9/1988 | White et al. | |
| 4,793,365 | A | | 12/1988 | Sensabaugh, Jr. et al. | |
| 4,836,224 | A | * | 6/1989 | Lawson et al. | 131/336 |
| 4,961,438 | A | | 10/1990 | Korte | |
| 4,989,619 | A | | 2/1991 | Clearman et al. | |
| 4,991,596 | A | * | 2/1991 | Lawrence et al. | 131/194 |
| 5,019,122 | A | * | 5/1991 | Clearman et al. | 131/194 |
| 5,020,548 | A | * | 6/1991 | Farrier et al. | 131/194 |
| 5,027,836 | A | * | 7/1991 | Shannon et al. | 131/194 |
| 5,033,483 | A | * | 7/1991 | Clearman et al. | 131/194 |
| 5,052,413 | A | * | 10/1991 | Baker et al. | 131/77 |
| 5,060,666 | A | * | 10/1991 | Clearman et al. | 131/194 |
| 5,065,776 | A | | 11/1991 | Lawson et al. | |
| 5,105,831 | A | * | 4/1992 | Banerjee et al. | 131/194 |
| 5,105,835 | A | | 4/1992 | Drewett et al. | |
| 5,105,838 | A | | 4/1992 | White et al. | |
| 5,137,034 | A | * | 8/1992 | Perfetti et al. | 131/194 |
| 5,178,167 | A | | 1/1993 | Riggs et al. | |
| 5,345,955 | A | | 9/1994 | Clearman et al. | |
| 5,396,911 | A | * | 3/1995 | Casey et al. | 131/352 |
| 5,551,451 | A | | 9/1996 | Riggs et al. | |
| 5,588,446 | A | | 12/1996 | Clearman | |
| 5,593,792 | A | | 1/1997 | Farrier et al. | |
| 5,727,571 | A | | 3/1998 | Meiring et al. | |
| 6,095,152 | A | | 8/2000 | Beven et al. | |
| 6,668,839 | B2 | | 12/2003 | Williams | |
| 6,823,873 | B2 | | 11/2004 | Nichols et al. | |
| 6,834,654 | B2 | | 12/2004 | Williams | |
| 7,231,923 | B2 | * | 6/2007 | Adiga et al. | 131/194 |
| 2002/0189625 | A1 | * | 12/2002 | Bushby et al. | 131/365 |
| 2004/0020503 | A1 | | 2/2004 | Williams | |
| 2005/0066986 | A1 | | 3/2005 | Nestor et al. | |
| 2007/0023056 | A1 | * | 2/2007 | Cantrell et al. | 131/194 |
| 2007/0215167 | A1 | * | 9/2007 | Crooks et al. | 131/335 |
| 2007/0215168 | A1 | * | 9/2007 | Banerjee et al. | 131/335 |
| 2009/0065011 | A1 | * | 3/2009 | Maeder et al. | 131/194 |
| 2009/0151739 | A1 | * | 6/2009 | Borschke et al. | 131/365 |

FOREIGN PATENT DOCUMENTS

| | | | |
|---|---|---|---|
| EP | 0 283 707 | | 2/1988 |
| EP | 0 712 584 | A2 | 7/1989 |
| EP | 0 419 981 | A2 | 9/1990 |
| EP | 535 695 | A2 | 10/1992 |

* cited by examiner

SMOKING ARTICLE

FIELD OF THE INVENTION

The present invention relates to tobacco products, such as smoking articles (e.g., cigarettes).

BACKGROUND OF THE INVENTION

Popular smoking articles, such as cigarettes, have a substantially cylindrical rod shaped structure and include a charge, roll or column of smokable material, such as shredded tobacco (e.g., in cut filler form), surrounded by a paper wrapper, thereby forming a so-called "smokable rod" or "tobacco rod." Normally, a cigarette has a cylindrical filter element aligned in an end-to-end relationship with the tobacco rod. Preferably, a filter element comprises plasticized cellulose acetate tow circumscribed by a paper material known as "plug wrap." Certain filter elements can incorporate polyhydric alcohols. See, for example, UK Pat. Spec. 755,475. Certain cigarettes incorporate a filter element having multiple segments, and one of those segments can comprise activated charcoal particles. See, for example, U.S. Pat. No. 5,360,023 to Blakley et al. and U.S. Pat. No. 6,537,186 to Veluz. Preferably, the filter element is attached to one end of the tobacco rod using a circumscribing wrapping material known as "tipping paper." It also has become desirable to perforate the tipping material and plug wrap, in order to provide dilution of drawn mainstream smoke with ambient air. Descriptions of cigarettes and the various components thereof are set forth in *Tobacco Production, Chemistry and Technology*, Davis et al. (Eds.) (1999). A cigarette is employed by a smoker by lighting one end thereof and burning the tobacco rod. The smoker then receives mainstream smoke into his/her mouth by drawing on the opposite end (e.g., the filter end) of the cigarette.

Through the years, there have been proposed various methods for altering the composition of mainstream tobacco smoke. In PCT Application Pub. No. WO 02/37990 to Bereman, it has been suggested that metallic particles and/or carbonaceous particles can be incorporated into the smokable material of a cigarette in an attempt to reduce the amounts of certain compounds in the smoke produced by that cigarette. In U.S. Patent Application Pub. No. 2005/0066986 to Nestor et al., it has been suggested that a tobacco rod can incorporate tobacco filler combined with an aerosol-forming material, such as glycerin. U.S. Pat. No. 6,874,508 to Shafer et al. proposes a cigarette having a paper wrapped tobacco rod having a tip portion that is treated with an additive, such as potassium bicarbonate, sodium chloride or potassium phosphate.

Various tobacco substitute materials have been proposed, and substantial listings of various types of those materials can be found in U.S. Pat. No. 4,079,742 to Rainer et al. and U.S. Pat. No. 4,771,795 to White et al. Certain cigarette-type products that employ non-tobacco materials (e.g., dried vegetable leaves, such lettuce leaves) as filler that is burned to produce smoke that resembles tobacco smoke have been marketed under the trade names "Cubebs," "Triumph," "Jazz," and "Bravo." See, for example, the types of materials described in U.S. Pat. No. 4,700,727 to Torigian. Furthermore, tobacco substitute materials having the trade names "Cytrel" and "NSM" were introduced in Europe during the 1970s. Representative types of proposed synthetic tobacco substitute materials, smokable materials incorporating tobacco and other components, and cigarettes incorporating those materials, are described in British Pat. No. 1,431,045; and U.S. Pat. No. 3,738,374 to Bennett; U.S. Pat. No. 3,844,294 to Webster; U.S. Pat. No. 3,878,850 to Gibson et al.; U.S. Pat. No. 3,931,824 to Miano et al.; U.S. Pat. No. 3,943,941 to Boyd et al.; U.S. Pat. No. 4,044,777 to Boyd et al.; U.S. Pat. No. 4,233,993 to Miano et al.; U.S. Pat. No. 4,286,604 to Ehretsmann et al.; U.S. Pat. No. 4,326,544 to Hardwick et al.; U.S. Pat. No. 4,920,990 to Lawrence et al.; U.S. Pat. No. 5,046,514 to Bolt; U.S. Pat. No. 5,074,321 to Gentry et al.; U.S. Pat. No. 5,092,353 to Montoya et al.; U.S. Pat. No. 5,778,899 to Saito et al.; U.S. Pat. No. 6,397,852 to McAdam; and U.S. Pat. No. 6,408,856 to McAdam. Furthermore, various types of highly processed smokable materials incorporating tobacco and other ingredients are set forth in U.S. Pat. No. 4,823,817 to Luke; U.S. Pat. No. 4,874,000 to Tamol et al.; U.S. Pat. No. 4,977,908 to Luke; U.S. Pat. No. 5,072,744 to Luke et al.; U.S. Pat. No. 5,829,453 to White et al. and U.S. Pat. No. 6,182,670 to White et al.

Certain types of coaxial or concentric-type smoking articles have been proposed. There have been proposed cigarette-type smoking articles have included tobacco smokable materials surrounding longitudinally extending cores of other materials. UK Pat. Application 2,070,409 proposes a smoking article having a rod of smoking material having at least one filament extending over at least a major portion of the length of the rod. U.S. Pat. No. 3,614,956 to Thornton proposes a smoking article having an annular outer portion made of tobacco smoking material and a central cylindrical core of absorbent material. U.S. Pat. No. 4,219,031 to Rainer et al. proposes a smoking article having a central core of carbonized fibers circumscribed by tobacco. U.S. Pat. No. 6,823,873 to Nichols et al. proposes a cigarette including an ignition element surrounded by tobacco, which is in turn surrounded by a composite outer wrapper. One type of cigarette-type smoking article has included a rod of tobacco smokable material surrounded a longitudinally extending annulus of some other material. For example, U.S. Pat. No. 5,105,838 to White et al. proposes a rod of smokable material, normally circumscribed by a layer of wrapping material, which is in turn circumscribed by an insulating material (e.g., glass filaments or fibers). PCT Application Pub. No. WO 98/16125 to Snaidr et al. proposes a smoking device constructed from a very thin cigarette designed to fit into a tubular ceramic cartridge.

Numerous references have proposed various smoking articles of a type that generate flavored vapor, visible aerosol, or a mixture of flavored vapor and visible aerosol. Some of those proposed types of smoking articles include tubular sections or longitudinally extending air passageways. See, for example, those types of smoking articles described in U.S. Pat. No. 3,258,015 to Ellis et al.; U.S. Pat. No. 3,356,094 to Ellis et al.; U.S. Pat. No. 3,516,417 to Moses; U.S. Pat. No. 4,347,855 to Lanzellotti et al.; U.S. Pat. No. 4,340,072 to Bolt et al.; U.S. Pat. No. 4,391,285 to Burnett et al.; U.S. Pat. No. 4,917,121 to Riehl et al.; U.S. Pat. No. 4,924,886 to Litzinger; and U.S. Pat. No. 5,060,676 to Hearn et al. Many of those types of smoking articles have employed a combustible fuel source that is burned to provide an aerosol and/or to heat an aerosol-forming material. See, for example, the background art cited in U.S. Pat. No. 4,714,082 to Banerjee et al. and U.S. Pat. No. 4,771,795 to White et al.; which are incorporated herein by reference in their entireties. See, also, for example, those types of smoking articles described in U.S. Pat. No. 4,756,318 to Clearman et al.; U.S. Pat. No. 4,714,082 to Banerjee et al.; U.S. Pat. No. 4,771,795 to White et al.; U.S. Pat. No. 4,793,365 to Sensabaugh et al.; U.S. Pat. No. 4,917,128 to Clearman et al.; U.S. Pat. No. 4,961,438 to Korte; U.S. Pat. No. 4,966,171 to Serrano et al.; U.S. Pat. No. 4,969,476 to Bale et al.; U.S. Pat. No. 4,991,606 to Serrano et al.; U.S. Pat. No. 5,020,548 to Farrier et al.; U.S. Pat. No. 5,033,483 to Clearman et al.; U.S. Pat. No. 5,040,551 to Schlatter et al.; U.S. Pat. No. 5,050,621 to Creighton et al.; U.S. Pat. No. 5,065,776 to Lawson; U.S. Pat. No. 5,076,296 to Nystrom et al.; U.S. Pat. No. 5,076,297 to Farrier et al.; U.S. Pat. No. 5,099,861 to Clearman et al.; U.S. Pat. No. 5,105,835 to Drewett et al.; U.S. Pat. No. 5,105,837 to Barnes et al.; U.S. Pat. No. 5,115,820 to Hauser et al.; U.S. Pat. No. 5,148,821 to Best et al.; U.S. Pat. No. 5,159,940 to Hayward et al.; U.S. Pat. No. 5,178,167 to Riggs et al.; U.S. Pat. No. 5,183,062 to Clearman et al.; U.S. Pat. No. 5,211,684 to Shannon et al.; U.S. Pat. No. 5,240,014 to Deevi et al.; U.S. Pat. No. 5,240,016 to Nichols et al.; U.S. Pat. No. 5,345,955 to Clearman et al.; U.S. Pat. No. 5,551,451 to Riggs et al.; U.S. Pat. No. 5,595,577 to Bensalem et al.; U.S. Pat. No. 5,819,751 to Barnes et al.; U.S. Pat. No. 6,089,857 to Matsuura et al.; U.S. Pat. No. 6,095,152 to Beven et al; U.S. Pat. No. 6,578,584 Beven; and U.S. Pat. No. 6,730,832 to Dominguez. Furthermore, certain types of cigarettes that employ carbonaceous fuel elements have been commercially marketed under the brand names "Premier" and "Eclipse" by R. J. Reynolds Tobacco Company. See, for example, those types of cigarettes described in *Chemical and Biological Studies on New Cigarette Prototypes that Heat Instead of Burn Tobacco*, R. J. Reynolds Tobacco Company Monograph (1988) and *Inhalation Toxicology,* 12:5, p. 1-58 (2000).

Yet other types of smoking articles, such as those types of smoking articles that generate flavored vapors by subjecting tobacco or processed tobaccos to heat produced from chemical or electrical heat sources are described in U.S. Pat. No. 4,848,374 to Chard et al.; U.S. Pat. No. 4,947,874 to Brooks et al.; U.S. Pat. No. 5,146,934 to Deevi et al.; U.S. Pat. No. 5,224,498 to Deevi; U.S. Pat. No. 5,285,798 to Banerjee et al.; U.S. Pat. No. 5,357,984 to Farrier et al.; U.S. Pat. No. 5,593,792 to Farrier et al.; U.S. Pat. No. 5,369,723 to Counts; U.S. Pat. No. 5,865,185 to Collins et al.; U.S. Pat. No. 5,878,752 to Adams et al.; U.S. Pat. No. 5,880,439 to Deevi et al.; U.S. Pat. No. 5,915,387 to Baggett et al.; U.S. Pat. No. 5,934,289 to Watkins et al.; and U.S. Pat. No. 6,164,287 to White; and U.S. Patent Application Pub. No. 2005/0016549 to Banerjee et al. One type of smoking article that has employed electrical energy to produce heat has been commercially marketed by Philip Morris Inc. under the brand name "Accord."

Smoking articles that employ tobacco substitute materials and smoking articles that employ sources of heat other than tobacco cut filler to produce tobacco-flavored vapors or tobacco-flavored visible aerosols have not received widespread commercial success. It would be highly desirable to provide a smoking article, such as a cigarette, that includes the ability to provide to a smoker many of the benefits and advantages of conventional cigarette smoking without delivering considerable quantities of incomplete combustion and pyrolysis products.

SUMMARY OF THE INVENTION

The present invention relates to a smoking article, and in particular, a rod shaped smoking article (e.g., a cigarette, a cigarillo, or a cigar). The smoking article includes a lighting end (i.e., an upstream end) and a mouth end (i.e., a downstream end). The smoking article includes an aerosol-generation system that includes (i) a heat generation segment, and (ii) an aerosol-generation region located downstream from the heat generation segment. The heat generation segment incorporates a short heat source (e.g., a combustible, carbonaceous fuel element). The aerosol-generation region incorporates an aerosol-forming material (e.g., glycerin and flavors). A mouth end piece is located at the mouth end of the smoking article, and the mouth end piece allows the smoking article to be placed in the mouth of the smoker to be drawn upon. Preferably, the mouth end piece has the form of a filter element.

Upstream from the heat generation segment (e.g., at the lighting end of a preferred smoking article) is a longitudinally extending segment comprising smokable material that is intended to be lit and burned. The aerosol that is generated by the burning of that smokable material is intended to be drawn into the mouth of the smoker through the mouth end of that smoking article. An aerosol-generation system is located between the lighting end segment and the mouth end piece. The heat generation segment of the aerosol-generation system is located downstream from, and adjacent to, the lighting end segment. The lighting end segment preferably is in a heat exchange relationship with the heat generation segment such that burning smokable material within the lighting end segment or smokable segment can ignite the combustible fuel element of the heat generation segment. The aerosol-generation region preferably is in a heat exchange relationship with the upstream components, and particularly with the heat generation segment. As such, heat generated by the burning fuel element acts to volatilize aerosol-forming material for aerosol-formation.

In use, the lighting end of the smoking article is lit, and the smokable material of the smokable segment undergoes thermal decomposition, and hence yields aerosol. For example, some portion or all of the smokable material within the lighting end segment can undergo burning, and hence yield aerosol that can be considered to be somewhat characteristic of the smoke of a traditional type of smoking article that is intended to burn tobacco cut filler. As such, when the mouth end of the smoking article is drawn upon by the smoker, the smoker can draw thermal decomposition products of the smokable material (i.e., aerosol components resulting from the action of heat upon the smokable material) into his mouth. For example, the smokable lighting end segment preferably incorporates tobacco cut filler, and when lit, that tobacco cut filler burns to yield components of tobacco smoke. During the smoking experience, the smokable lighting end segment burns towards the heat source of the aerosol-generating system. Although it is preferred that the heat source and smokable lighting end are physically separate, the heat source and the smokable lighting end segment are in a heat exchange relationship with one another. As a result, it is highly preferred that at some point during the period when the smokable lighting end segment is burning, the burning smokable material thereof causes ignition of the heat source of the heat generation segment. Specifically, it is highly preferable that the size and shape of the smokable material within the smokable lighting end segment, the configuration or packing of the smokable material, and the selection of composition of smokable materials are such that when the smokable material is burned, the smokable segment produces a coal and/or ash that is sufficient to result in ignition/lighting and burning of the heat source (e.g., fuel element). Furthermore, although preferably physically separate, the heat source and the aerosol-generation region are in a heat exchange relationship with one another. As a result, heat resulting from the burning heat source heats the aerosol-generation region, and as such, acts to volatilize the aerosol-forming material incorporated within the aerosol-generation region. Thus, as the smoker continues to draw on the mouth end of the smoking article, the smoker receives an aerosol that is produced as a result of the action of heat upon the aerosol-generation region. As such, when the mouth end piece of the cigarette is drawn upon by the smoker, the smoker can draw into his mouth smoke from burning tobacco cut filler, as well as volatilized aerosol-forming material, and other components resulting from the burning or other action of heat upon the components of the smokable segment and the aerosol-generation system. Aerosol can be produced until the smokable segment and the heat source extinguish.

A preferred smoking article of the present invention, when smoked, is capable of providing mainstream aerosol that may be characterized as being flavorful and satisfying. Highly preferred cigarettes provide certain of the flavors, sensations and satisfaction of popular cigarettes that burn tobacco cut filler, because those preferred cigarettes generate mainstream aerosol, at least in part, by burning, charring or otherwise causing thermal degradation of tobacco cut filler.

DETAILED DESCRIPTION OF THE PREFERRED EMBODIMENTS

Aspects and embodiments of the present invention relating to various smoking articles are illustrated with reference to FIGS. 1 through 6. Like components are given like numeric designations throughout the figures.

Figure 1:
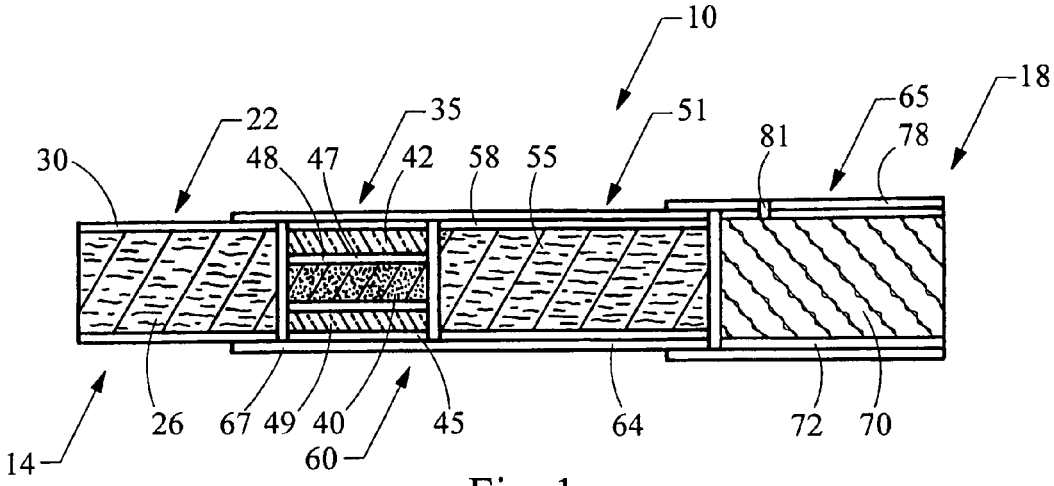
FIG. 1 depicts a longitudinal cross-sectional view of a first embodiment of a smoking article.

Referring to FIG. 1, a first embodiment of a representative smoking article 10 in the form of a cigarette is shown. The smoking article 10 has a rod-like shape, and includes a lighting end 14 and a mouth end 18.

At the lighting end 14 is positioned a longitudinally extending, generally cylindrical smokable lighting end segment 22 including smokable material 26. A representative smokable material 26 preferably is a plant-derived material (e.g., tobacco material in cut filler form). An exemplary cylindrical smokable lighting end segment 22 includes a charge or roll of the smokable material 26 (e.g., tobacco cut filler) wrapped or disposed within, and circumscribed by, a paper wrapping material 30. As such, the longitudinally extending outer surface of that cylindrical smokable lighting end segment 22 is provided by the wrapping material 30. Both ends of the segment 22 are open to expose the smokable material 26. It is preferable that the smokable lighting end segment 22 be configured so that smokable material 26 and wrapping material 30 each extend along the entire length thereof.

Located downstream from the smokable lighting end segment 22 is a longitudinally extending, generally cylindrical heat generation segment 35. The heat generation segment 35 incorporates a heat source 40 circumscribed by insulation 42, which is coaxially encircled by wrapping material 45. The heat source 40 preferably is a combustible fuel element having a generally cylindrical shape and incorporating a combustible carbonaceous material. Carbonaceous materials generally have very high carbon contents. Exemplary preferred carbonaceous materials have carbon contents of greater than about 70 percent, often greater than about 80 percent, and frequently greater than about 90 percent, on a dry weight basis. Representative fuel elements may contain components other than carbonaceous materials (e.g., tobacco components such as powdered tobaccos or tobacco extracts; flavoring agents; salts such as sodium chloride, potassium chloride and sodium carbonate; graphite fibers; iron oxide powder; glass filaments; powdered calcium carbonate; alumina granules; ammonia sources, such as ammonia salts; and/or binding agents such as guar gum, ammonium alginate and sodium alginate). Representative fuel elements can have a generally cylindrical shape, having a length of about 12 mm and an overall outside diameter of about 4.2 mm. See, for example, the types of fuel element components, formulations and designs set forth in U.S. Pat. No. 5,551,451 to Riggs et al. A representative fuel element preferably is extruded or compounded using a ground or powdered carbonaceous material, and has a density that is greater than about 0.5 g/cm$^3$, often greater than about 0.7 g/cm$^3$, and frequently greater than about 1 g/cm$^3$, on a dry weight basis.

A layer of insulation 42 preferably includes by glass filaments or fibers. Preferably, the insulation 42 acts as a jacket that assists in maintaining the heat source 40 firmly in place within the smoking article 10. The insulation 42 can be provided as a multi-layer component including an inner layer or mat 47 of non-woven glass filaments, an intermediate layer of reconstituted tobacco paper 48, and an outer layer of non-woven glass filaments 49. Preferably, both ends of the heat generation segment 35 are open to expose the heat source 40 and insulation 42 to the adjacent segments. Preferably, the heat source 40 and the insulation 42 around it are configured so that the length of both materials is co-extensive (i.e., the ends of the insulating jacket 42 are flush with the respective ends of the heat source 40). Optionally, the insulation 42 may extend slightly beyond (e.g., from about 0.5 mm to about 2 mm beyond) either or both ends of the heat source 40. However, it is preferred that the ends of each of the insulation 42 and the heat source 40 be virtually flush with one another at the downstream end of the heat generation segment 35. It also is highly preferred that aerosol produced when the smokable lighting end segment 22 is burned during use of the smoking article 10 readily be able to pass through the heat generation segment 35 during draw by the smoker on the mouth end 18.

The heat generation segment 35 is positioned adjacent the downstream end of the smokable lighting end segment 22 such that those segments are axially aligned in an end-to-end relationship, preferably abutting one another. The close proximity of the heat generation segment 35 and the smokable lighting end segment 22 provides for an appropriate heat exchange relationship (e.g., such that the action of burning smokable material within the smokable lighting end segment 22 acts to ignite the heat source of the heat generation segment 35). The outer cross-sectional shapes and dimensions of those smokable and heat generation segments 22, 35, when viewed transversely to the longitudinal axis of the smoking article, most preferably are essentially identical to one another (e.g., both comprise cylinders with essentially identical diameters).

The cross-sectional shape and dimensions of the heat generation segment 35, prior to burning, can vary. Preferably, the cross-sectional area of the heat source 40 makes up about 10 percent to about 35 percent, often about 15 percent to about 25 percent of the total cross-sectional area of that segment 35; while the cross-sectional area of the outer or circumscribing region comprising the insulation 42 and relevant outer wrapping materials make up about 65 percent to about 90 percent, often about 75 percent to about 85 percent of the total cross-sectional area that segment 35. For example, for a cylindrical cigarette having a circumference of about 24 mm to about 26 mm, a representative heat source 40 has a generally circular cross-sectional shape with an outer diameter of about 2.5 mm to about 5 mm, often about 3 mm to about 4.5 mm.

Located downstream from the heat generation segment 35 is a longitudinally extending, preferably cylindrical aerosol-generation segment 51. The aerosol-generation segment 51 preferably incorporates a substrate material 55 that, in turn, acts as a carrier for an aerosol-forming agent or material (not shown). An exemplary aerosol-generation segment 51 preferably incorporates a reconstituted tobacco material that includes, for example, processing aids, flavoring agents and glycerin.

The foregoing components of the aerosol-generation segment 51 can be disposed within, and circumscribed by, a wrapping material 58. A preferred wrapping material 58 facilitates transfer of heat from the upstream end 14 of the smoking article 10 (e.g., from the heat generation segment 35) to components of the aerosol-generation segment 51. That is, the aerosol-generation segment 51 and the heat generation segment 35 preferably are configured in a heat exchange relationship with one another. The heat exchange relationship preferably is such that sufficient heat from the heat source is supplied to the aerosol-formation region to volatilize aerosol-forming material for aerosol-formation. Preferably, the heat exchange relationship is achieved by positioning those segments in close proximity to one another. A heat exchange relationship also can be achieved by extending a heat conductive material from the vicinity of the heat source 40 into the region occupied by the aerosol-generation segment 51.

For example, a representative wrapping material 58 for the substrate material 55 includes heat conductive properties, and can have the form of a metal or metal foil (e.g., aluminum) tube, or a laminated material having on outer surface comprised of paper and an inner surface comprised of metal foil. In this representative example, the metal foil will conduct heat from the heat generation segment 35 to the aerosol-generation segment 51, where it will be able to volatilize the flavor components therein.

Preferably, both ends of the aerosol-generation segment 51 are open to expose the substrate material 55 thereof. It is highly preferred that components of the aerosol produced by burning the smokable lighting end segment 22 during use of the smoking article readily be able to pass through the aerosol-generation segment 51 during draw on the mouth end 18.

Together, the heat generating segment 35 and the aerosol-generating segment 51 form an aerosol-generation system 60. The aerosol-generation segment 51 preferably is positioned adjacent the downstream end of the heat generation segment 35 such that those segments 51, 35 are axially aligned in an end-to-end relationship. Most preferably, those segments 51, 35 are physically separate relative to one another. Those segments can abut one another, or be positioned in a slight spaced apart relationship. The outer cross-sectional shapes and dimensions of those segments, when viewed transversely to the longitudinal axis of the smoking article 10, preferably are essentially identical to one another. The physical arrangement of those components preferably is such that heat is transferred (e.g., by means that includes conductive and convective heat transfer) from the heat source 40 to the adjacent substrate material 55, throughout the time that the heat source is activated (e.g., burned) during use of the smoking article 10.

The components of the aerosol-generation system 60 are attached to one another, and secured in place, using an over-wrap material 64. For example, a paper wrapping material, or most preferably, a laminated material having on outer surface comprised of paper and an inner surface comprised of metal foil, can circumscribe the outer longitudinally extending surface of the aerosol-generation segment 51 and an adjacent region of the heat generation segment 35. The inner surface of the over-wrap material 64 preferably is secured to the outer surface of the outer wrapping material 45 of the heat generation segment 35 and the outer surface of the outer wrapping material 58 of the aerosol-generation segment 51 using a suitable adhesive.

The smokable lighting end segment 22 preferably is attached to aerosol-generating system 60 using tipping material 67. For example, a tipping paper 67 can circumscribe adjacent regions of the smokable lighting end segment 22 and the heat generation segment 35. The inner surface of the tipping material 67 preferably is secured to the outer surface of the outer wrapping material 30 of smokable lighting end segment 22 and the outer surface of the outermost wrapping material 64 of the aerosol-generation system 60 using a suitable adhesive. If desired, the wrapping material 30 of the smokable lighting end segment 22, the circumscribing materials 45, 64 of the heat generation segment 35, and/or the tipping paper 64 that secures those segments to one another, can be treated in the manner set forth in U.S. Pat. No. 6,874,508 to Shafer et al.

The smoking article 10 preferably includes a suitable mouthpiece such as, for example, a filter element 65, positioned at the mouth end 18 thereof. Preferably, the filter element 65 is positioned adjacent one end of the aerosol-generating segment 51, such that the filter element and aerosol-generating segment 51 are axially aligned in an end-to-end relationship, preferably abutting one another. It is preferred that the general cross-sectional shapes and dimensions of those segments 51, 65, when viewed transversely to the longitudinal axis of the smoking article, are essentially identical to one another. The filter element 65 incorporates filter material 70 (e.g., plasticized cellulose acetate tow) that is over-wrapped along the longitudinally extending surface thereof with circumscribing plug wrap material 72. Both ends of the filter element 65 are open to permit the passage of aerosol therethrough.

The aerosol-generating system 60 preferably is attached to filter element 65 using tipping material 78. The tipping material 78 circumscribes both the entire length of the filter element 65 and an adjacent region of the aerosol-generation system 60. The inner surface of the tipping material 78 preferably is secured to the outer surface of the plug wrap 72 and the outer surface of the outer wrapping material 64 of the aerosol-generation system 60, using a suitable adhesive.

The smoking article preferably includes an air dilution means, such as a series of perforations 81, each of which extend through the filter element tipping material 78 and plug wrap material 72.

The overall dimensions of the cigarette, prior to burning, can vary. Preferred cigarettes are cylindrically shaped rods having circumferences of about 20 mm to about 27 mm, and preferably about 22 mm to about 25 mm. Preferred cigarettes are cylindrically shaped rods that have overall lengths of about 70 mm to about 130 mm, generally about 80 mm to about 120 mm, and often have overall lengths of about 83 mm to about 100 mm. Preferred smokable lighting end segments have lengths of at least about 3 mm, generally at least about 5 mm, often at least about 8 mm, and frequently at least about 10 mm; when preferred smokable lighting end segments have lengths of not more than about 30 mm, generally not more than about 25 mm, often not more than about 20 mm, and frequently not more than about 15 mm. Preferred filter elements have lengths of about 10 mm to about 40 mm, and generally about 15 mm to about 35 mm. The aerosol-generation system 51 that is located between the smokable lighting end segment 22 and the filter element 65 has an overall length that can vary; but preferably the length of thereof is about 20 mm to about 50 mm, and generally about 25 mm to about 40 mm. The heat generation segment 35 of the aerosol-generation system preferably has a length of about 5 mm to about 30 mm, generally about 10 mm to about 15 mm; and the aerosol-generation segment 51 of the aerosol-generation system 60 preferably has an overall length of about 10 mm to about 45 mm, generally about 20 to about 30 mm.

The amount of smokable material 26 employed to manufacture the smokable lighting end segment 22 can vary. Preferably, a representative smokable lighting end segment 22, manufactured predominantly from tobacco cut filler, includes at least about 20 mg, generally at least about 50 mg, often at least about 75 mg, and frequently at least 100 mg, of tobacco material, on a dry weight basis. Preferably, a representative smokable lighting end segment, manufactured predominantly from tobacco cut filler, includes up to about 400 mg, generally up to about 350 mg, often up to about 300 mg, and frequently up to about 250 mg, of tobacco material, on a dry weight basis. Certain smokable lighting end segments manufactured predominantly from tobacco cut filler may include less than about 85 mg, often less than about 60 mg, and even less than about 30 mg, of tobacco material, on a dry weight basis. The packing density of the smokable material within the smokable lighting end segment most preferably is less than the density of the fuel element. When the smokable material has the form of cut filler, the packing density of the smokable material within the smokable lighting end segment is less than about 400 mg/cm$^3$, and generally less than about 350 mg/cm$^3$; while the packing density of the tobacco material within the smokable lighting end segment can exceed about 100 mg/cm$^3$, often exceeds about 150 mg/cm$^3$, and frequently exceeds about 150 mg/cm$^3$. Most preferably, the smokable lighting end segment 22 is composed entirely of smokable material, and does not include a carbonaceous fuel element component.

The combined amount of aerosol-forming agent and substrate material 55 employed in the aerosol-generation segment 51 can vary. The material normally is employed so as to fill the appropriate section of the aerosol-generation segment 51 (e.g., the region within the wrapping material 58 thereof) at a packing density of less than about 400 mg/cm$^3$, and generally less than about 350 mg/cm$^3$; while the packing density of the aerosol-generation segment 51 generally exceeds about 100 mg/cm$^3$, and often exceeds about 150 mg/cm$^3$.

During use, the smoker lights the lighting end 14 of the smoking article 10 using, for example, a match or cigarette lighter, in a manner similar to the way that conventional smoking articles are lit. As such, the smokable material 26 of the smokable lighting end segment 22 begins to burn. The mouth end 18 of the smoking article 10 is placed in the lips of the smoker. Thermal decomposition products (e.g., components of tobacco smoke) generated by the burning smokable material 26 are drawn through the smoking article 10, through the filter element 65, and into the mouth of the smoker. That is, when smoked, the smoking article yields visible mainstream aerosol that resembles the mainstream tobacco smoke of traditional cigarettes that burn tobacco cut filler. Depending upon factors, such as the type and configuration of the smokable material, the smokable lighting end segment 22 of the smoking article 10 can burn down, in a manner similar to a traditional type of cigarette that burns tobacco cut filler, and the smokable lighting end segment 22 can produce an ash that preferably is similar in certain regards to other traditional types of cigarettes that burn tobacco cut filler. Burning of the smokable lighting end segment 22 causes the heat source 40 of the heat generation segment 35, which preferably is positioned downstream from the smokable lighting end segment 22, to be heated.

For a smoking article 10 having a relatively short smokable lighting end segment 22, the action of lighting the smokable lighting end segment 22 also may have some effect upon the lighting of the heat source 40. Thus, the heat source 40 is ignited or otherwise activated (e.g., begins to burn), and as a consequence of the heat exchange relationship between the heat generation segment 35 and the aerosol-generation segment 51, the aerosol-forming material within the aerosol-generation segment 51 is heated. Volatilized aerosol-forming material is entrained in the air that is drawn through that region (the aerosol generation system 60) of the smoking article 10. The aerosol so formed may be drawn through the filter element 65 and into the mouth of the smoker. During certain periods of use of a smoking article 10, it is preferable that aerosol-formed within the aerosol-generation segment 51 is drawn through the filter element 65 and into the mouth of the smoker, along with the aerosol (i.e., smoke) formed as a result of the thermal degradation of the smokable material within the lighting segment 22. Thus, the mainstream aerosol produced by the smoking article 10 includes tobacco smoke produced by the thermal decomposition of the tobacco cut filler and volatilized aerosol-forming material. Preferably, for early puffs (i.e., during and shortly after lighting), most of the mainstream aerosol results from thermal decomposition of the smokable lighting end segment 22, and hence contains thermal decomposition products of the smokable material 26. Preferably, for later puffs (i.e., after the smokable lighting end segment has been consumed and the heat source of the aerosol-generation system has been ignited), most of the mainstream aerosol that is provided is produced by the aerosol-generation system 60. The smoker can smoke a smoking article 10 for a desired number of puffs. However, when the smokable material 26 has been consumed, and the heat source 40 extinguishes, the use of the smoking article is ceased (i.e., the smoking experience is finished).

For a preferred smoking article 10, the smokable material 26 and outer wrapping material 30 of the smokable lighting end segment burn down, essentially as is the case for a traditional tobacco burning cigarette. Ash and charred materials that result as the resulting hot coal (also known as a fire-cone) passes downstream from the lighting end can be flicked, or otherwise removed from the cigarette, essentially in the manner that ash generated from burned tobacco cut filler is removed from a traditional type of tobacco burning cigarette. The heat source 40 within the aerosol-generating system 60 is burned to supply heat to volatilize aerosol-forming material located within the aerosol-generation segment 51. It is highly preferred that the components of the aerosol-generation segment 51 not experience thermal decomposition (e.g., charring or burning) to any significant degree.

Figure 2:
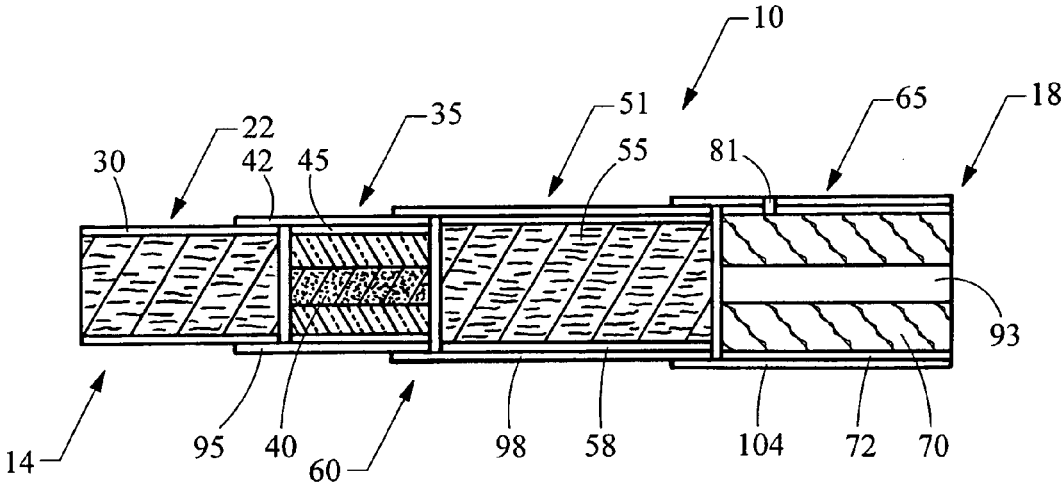
FIG. 2 depicts a longitudinal cross-sectional view of a second embodiment of a smoking article.

Referring to FIG. 2, a second embodiment of a representative smoking article 10 in the form of a cigarette is shown. The cigarette 10 has rod-like shape, and includes a lighting end 14 and a mouth end 18. The cigarette 10 includes a smokable lighting end segment 22 located at the lighting end 14, a filter segment 65 located at the mouth end 18, and a centrally located aerosol-generation segment 60. The aerosol-generation segment includes a heat generation segment 35 that is located adjacent to the smokable lighting end segment 22, and an aerosol-formation segment 51 that is located adjacent to the filter element 65. A representative heat generation segment 35 preferably includes a generally cylindrical carbonaceous heat source 40 circumscribed by insulation 42. The composition and dimensions of the various segments of the smoking article 10, and its preferred method of use, are generally similar to those set forth previously with reference to FIG. 1.

The smokable lighting end segment 22 includes an outer wrapping material 30 that circumscribes the outer longitudinally extending portion of that segment. The heat generation segment 35 includes a heat source 40 longitudinally circumscribed by insulation 42, and a wrapping material 45 that circumscribes the insulation 42. The aerosol-generation segment 51 includes a substrate material 55 that, in turn, acts as a substrate or carrier for an aerosol-forming material (not shown), and a wrapping material 58 that circumscribes the substrate material 55. The filter element 65 may have the shape of a tube comprised of steam bonded cellulose acetate filter material 70 and include a central, longitudinally extending air passageway 93. The filter element 65 also can include an optional, though preferable, plug wrap material 72 that circumscribes the outer longitudinally extending portion of that segment 65.

The generally cylindrical segments 22, 35, 51, 65 that make up the cigarette 10 preferably are aligned in an end-to-end relationship, abutting one another. The smokable lighting end segment 22 is attached and secured to the heat generation segment 35 using a wrapping material 95 that circumscribes at least a portion of the length of smokable lighting end segment 22 (e.g., that portion of the smokable lighting end segment immediately adjacent the heat generation segment 35), and preferably circumscribes the entire length of the heat generation segment 35. The aerosol-generation segment 51 is attached and secured to the heat generation segment 35 by a wrapping material 98 that circumscribes at least a portion of the length of the heat generation segment 35 (e.g., that portion of the heat generation segment 35 immediately adjacent the aerosol-generation segment 51), and preferably circumscribes the entire length of the aerosol-generation segment 51. The aerosol-generation segment 51 is attached and secured to the filter element 65 using a tipping material 104 that circumscribes at least a portion of the length of the aerosol-generation segment 51 (e.g., that portion of the aerosol-generation segment 51 immediately adjacent the filter segment 65), and preferably circumscribes the entire length of the filter segment 65. Optionally, the tipping material 104 and the plug wrap 72 may be perforated with a series of holes 81, in order to provide some degree of air dilution to the smoking article 10.

Figure 3:
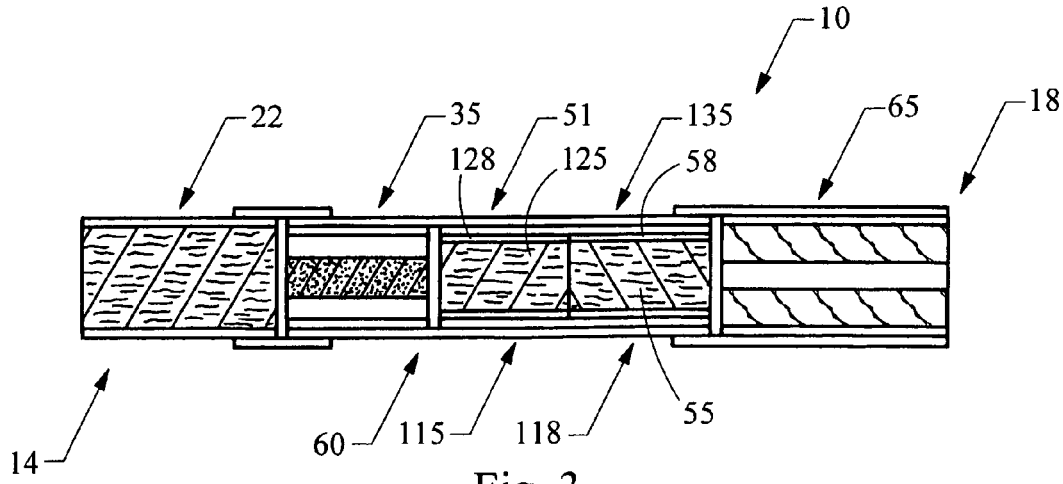
FIG. 3 depicts a longitudinal cross-sectional view of a third embodiment of a smoking article.

Referring to FIG. 3, a third embodiment of a representative smoking article 10 in the form of a cigarette is shown. The cigarette 10 has rod-like shape, and includes a lighting end 14 and a mouth end 18. The cigarette 10 includes a smokable lighting end segment 22 located at the lighting end 14, a filter element 65 (e.g., a cylinder of cellulose acetate tow) located at the mouth end 18, and a centrally located aerosol-generation segment 60. The aerosol-generation segment includes a heat generation segment 35 that is located adjacent to the smokable lighting end segment 22, and an aerosol-formation segment 51 that is located adjacent to the filter element 65. The composition and dimensions of the various segments of the smoking article 10, and its preferred method of use, are generally similar to those set forth previously with reference to FIGS. 1 and 2.

The aerosol-generation segment 51 includes at least two longitudinally aligned aerosol-releasing portions 115, 118. The first aerosol-releasing portion 115, positioned adjacent the heat generation segment 35, includes substrate material 125 that, in turn, acts as a substrate or carrier for a flavoring agent or material (not shown), and provides a source of sensory characteristics to the mainstream aerosol produced by the cigarette. The substrate material 125 of the first aerosol-releasing portion 115 can also act as a carrier for an aerosol-forming material (not shown). The first aerosol-releasing portion 115 also includes a wrapping material 128 that circumscribes the substrate material 125 of the portion 115. The second aerosol-releasing portion 118, positioned adjacent the filter segment 65, includes substrate material 55 that acts as a substrate or carrier for an aerosol-forming material (not shown), and a wrapping material 58 that circumscribes the substrate material 55 of the portion 118. For the embodiment shown, the two aerosol-releasing portions 115, 118 of the aerosol-generation segment 51 are shown as being circumscribed along their outer surfaces with a single layer of wrapping material 135.

If desired, the positioning of the first aerosol-releasing portion 115 and the second aerosol-releasing portion 118 within the aerosol-generation segment 51 can be reversed. For example, tobacco-containing segments can be of the types that have been incorporated within those cigarettes commercially marketed under the trade name "Eclipse" by R. J. Reynolds Tobacco Company.

Preferred wrapping materials 58, 128 of the aerosol-releasing portions 118, 115 facilitate transfer of heat from the upstream end 14 of the cigarette 10. That is, the aerosol-generation segment 51 and the heat generation segment 35 are configured in a heat exchange relationship with one another. Representative wrapping materials 58, 128 include heat conductive properties, and may have the form of a metal or metal foil (e.g., aluminum) tube, or a laminated material having on outer surface comprised of paper and an inner surface comprising metal foil.

The substrate material 125 and any substance carried thereby that are incorporated into the first aerosol-releasing portion 115 of the aerosol-generation segment 51 can vary. In one embodiment, the first aerosol-releasing portion 115 incorporates a blend of flavorful and aromatic tobaccos in cut filler form. Those tobaccos, in turn, can be treated with aerosol-forming material and/or at least one flavoring agent. In another embodiment, the first aerosol-releasing portion 115 incorporates a processed tobacco (e.g., a reconstituted tobacco manufactured using cast sheet or papermaking types of processes) in cut filler form. That tobacco, in turn, can be treated with aerosol-forming material and/or at least one flavoring agent. In another embodiment, the inner metal surface of the wrapping material 128 of the first aerosol-releasing portion 115 can act as a carrier for aerosol-forming material and/or at least one flavoring agent. For example, aerosol-forming material and/or at least one flavoring agent can be incorporated within a film formed on the inner metallic surface of a laminate of paper and aluminum foil using a polymeric film forming agent, such as ammonium alginate, sodium alginate, guar gum, ethyl cellulose, starch, or the like. In another embodiment, aerosol-forming material and/or at least one flavoring agent can be carried by a plurality of metal pieces that can be dispersed throughout tobacco filler within the first aerosol-releasing portion. For example, aerosol-forming material can be carried on the surface of about 10 to about 20 strips of heat conductive material (e.g., thin aluminum foil), each strip being about 1 mm to about 2 mm wide, and about 10 mm to about 20 mm long. In yet another embodiment, the components of the first aerosol-releasing portion 115 can include aerosol-forming material and/or at least one flavoring agent carried by a gathered or shredded paper-type material, such as a paper incorporating particles of absorbent carbon, alumina, or the like.

The aerosol-generation system 60 has an overall length that can vary; but preferably the length of thereof is about 30 mm to about 50 mm. The heat generation segment 35 of the aerosol-generation system preferably has a length of about 10 mm to about 30 mm, and the aerosol-generation segment 51 of the aerosol-generation system preferably has an overall length of about 20 mm to about 40 mm. Preferably, the length of the first aerosol-releasing portion 115 of the aerosol-generation system is about 10 mm to about 30 mm; and the length of the second aerosol-releasing portion 118 of the aerosol-generation system is about 10 mm to about 30 mm.

Figure 4:
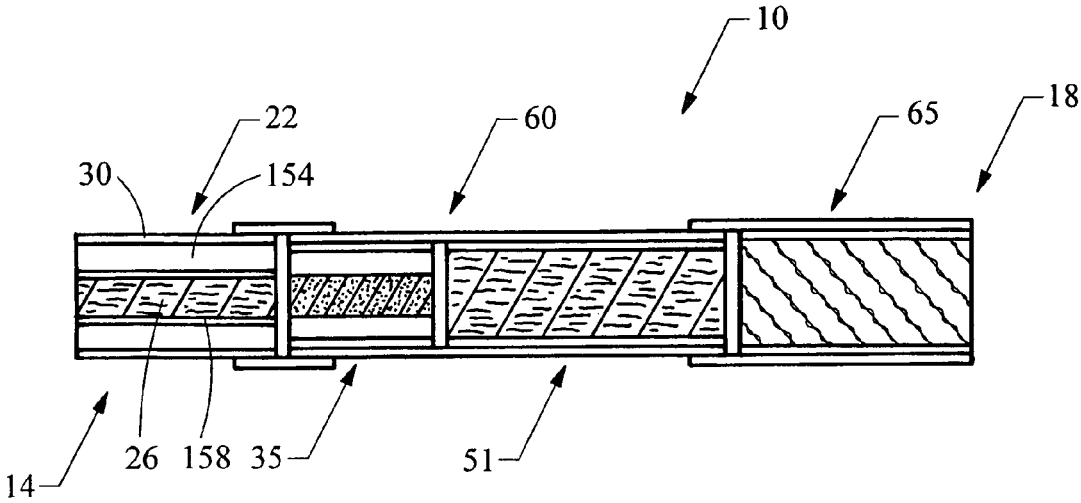
FIG. 4 depicts a longitudinal cross-sectional view of a fourth embodiment of a smoking article.

Referring to FIG. 4, a fourth embodiment of a representative smoking article 10 in the form of a cigarette is shown. The cigarette 10 has rod-like shape, and includes a lighting end 14 and a mouth end 18. The cigarette 10 includes a smokable lighting end segment 22 located at the lighting end 14, a filter element 65 located at the mouth end, and a centrally located aerosol-generation segment 60. The aerosol-generation segment includes a heat generation segment 35 that is located adjacent to the smokable lighting end segment, and an aerosol-formation segment 51 that is located adjacent to the filter element. The composition and dimensions of the various segments of the smoking article 10, and its preferred method of use, are generally similar to those set forth previously with reference to FIGS. 1 through 3.

The smokable lighting end segment 22 includes an inner longitudinally extending region of smokable material 26, an insulative jacket 154 that longitudinally circumscribes the smokable material 26, an optional longitudinally extending wrapper 158 for the smokable material 26 (e.g., in order to maintain physical separation of the smokable material from the insulation), and a wrapping material 30 that circumscribes the smokable lighting end segment 22. A representative smokable lighting end segment 22 preferably has a length of about 10 mm to about 30 mm, often about 15 mm to about 25 mm.

The cross-sectional dimensions of the smokable lighting end segment 22 can vary. Preferably, the cross-sectional area comprising smokable material 26 makes up about 10 percent to about 40 percent, often about 15 percent to about 25 percent of the total cross-sectional area of that segment; while the cross-sectional area of the outer or circumscribing insulative jacket 154 makes up about 60 percent to about 90 percent, often about 75 percent to about 85 percent of the total cross-sectional area that segment. For example, for a cylindrical cigarette having a circumference of about 24 mm to about 26 mm, a representative core of smokable filler 26 comprises a generally circular cross-sectional shape, and an outer diameter of about 2.5 mm to about 5 mm, often about 3 mm to about 4.5 mm.

Figure 5:
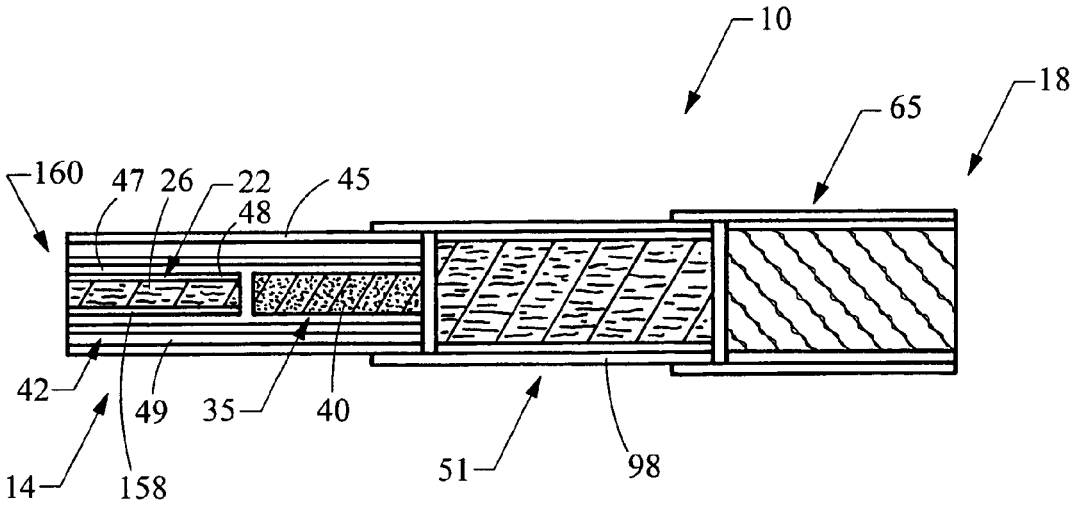
FIG. 5 depicts a longitudinal cross-sectional view of a fifth embodiment of a smoking article.

Referring to FIG. 5, there is shown a fifth embodiment of a representative cigarette 10 that is similar in many respects to the smoking article that has been described previously with reference to FIG. 2. However, although physically separate (e.g., in an abutting end-to-end relationship), the smokable material 26 of the smokable lighting end segment 22 and the heat source 40 of the heat generation segment 35 each are positioned within a single circumscribing insulative jacket 160. The insulative jacket 160 surrounds both the smokable material 26 and the heat source 40 to form a combined length of the segments 22, 35. The smokable material 26 can be circumscribed by an optional wrapper 158; and as such, the smokable material 26 and the heat source 40 each can be aligned to have an overall configuration that preferably is generally cylindrical in nature. The representative insulative jacket 160 preferably includes an inner layer of non-woven glass filament mat 47, and intermediate layer of reconstituted tobacco paper 48, and an outer layer of non-woven glass filament mat 49. An outer wrapping material 45 circumscribes the outer longitudinally extending periphery of the insulating jacket 42.

The composition of the smokable material 26 within the smokable lighting end segment 22 can vary. The smokable material 26 most preferably has is comprised essentially of tobacco cut filler. The smokable material 26 alternatively can have the form of a compressed cylinder of tobacco material (e.g., shredded pieces of tobacco lamina and/or stem that have been compressed into a desired shape) or as a generally cylindrical extrudate incorporating tobacco material. The smokable lighting end segment 22 can have a length that can vary; and representative smokable lighting end segments 22 have lengths of at least about 3 mm, often at least about 4 mm, and frequently at least about 5 mm. Preferably, the smokable lighting end segment 22 has a length that does not exceed about 25 mm, and often does not exceed about 20 mm, and frequently does not exceed about 15 mm. For a cigarette having relatively short smokable lighting end segment (e.g., having a smokable lighting end segment 22 of less than about 12 mm), the action of lighting the smokable lighting end segment 22 also can have some effect upon lighting of the heat source 40.

Wrapping material 98, which can be a laminate of paper and metal foil, circumscribes the length of the aerosol-generation segment 51 and a portion of the wrapping material 45 of the front two segment components in the region adjacent the aerosol-generation segment 51. As such, the lighting end and heat generation segments 22, 35 are secured to the remainder of the cigarette 10.

Figure 6:
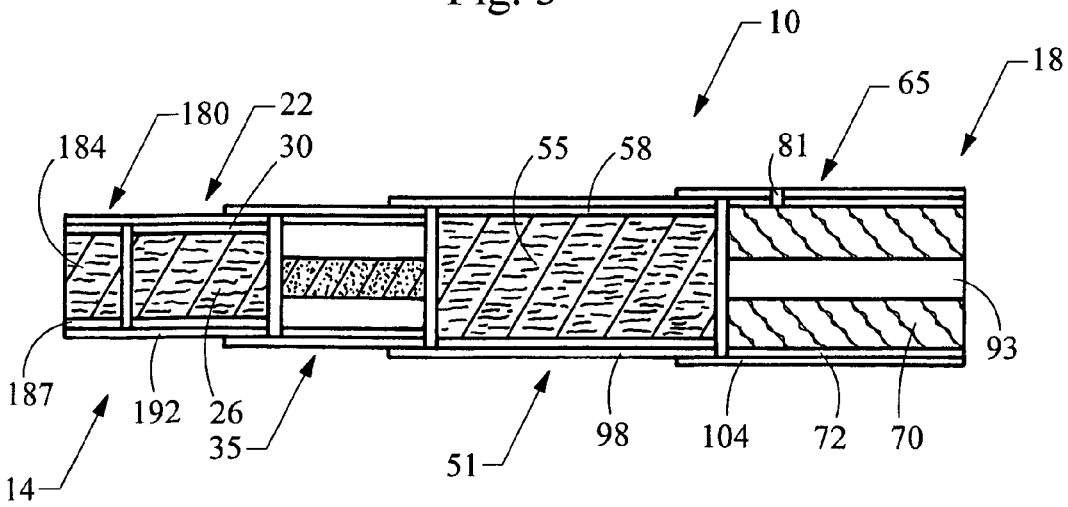
FIG. 6 depicts a longitudinal cross-sectional view of a sixth embodiment of a smoking article.

Referring to FIG. 6, there is shown a sixth embodiment of a representative cigarette 10 that is similar in many respects to the smoking article that has been described previously with reference to FIG. 2. However, the lighting end 14 includes a smokable lighting end segment 22 positioned adjacent the heat generation segment 35, and an extreme lighting end segment 180 positioned upstream from the smokable lighting end segment 22. The smokable lighting end segment 22 includes smokable material 26 that is circumscribed by a wrapping material 30, and the extreme lighting end segment 180 is a smokable or non-smokable material 184 circumscribed by a wrapping material 187. An over-layer wrapping material 192 acts to maintain the two segments in position.

The smokable lighting end segment 22 preferably incorporates smokable material 26 having the form of tobacco cut filler. The smokable lighting end segment can be relatively short. For example, a representative smokable lighting end segment can have a length of less than about 15 mm, often less than about 10 mm, and frequently less than about 8 mm; and a length of at least about 3 mm, and frequently at least about 5 mm. The extreme lighting end segment 180 also can be relatively short. For example, a representative lighting end segment 180 can have a length of not more than about 10 mm, and often less than about 8 mm; and a length of at least about 3 mm, and frequently at least about 5 mm. The extreme lighting end segment 180 can act as a type of retaining means in order to assist in preventing tobacco cut filler within the smokable lighting end segment 22 from falling from the cigarette during normal handling and use.

The extreme lighting end segment 180 can incorporate a smokable material 184. In one embodiment, the smokable material 184 can be a reconstituted tobacco sheet that is gathered using techniques such as those set forth in U.S. Pat. No. 4,807,809 to Pryor et al. or shredded and gathered using techniques such as those set forth in U.S. Pat. No. 5,025,814 to Raker. For example, a cylindrical extreme lighting end segment 180 having a length of about 5 mm to about 10 mm can be provided by gathering a web of cast sheet type reconstituted tobacco having a width of about 50 mm, which reconstituted tobacco is produced primarily using a Turkish Ismir A type of tobacco.

The extreme lighting end segment 180 can incorporate a non-smokable material 184. The material 184 can be a highly porous or air-permeable disc comprising a material such as alumina. The material also can include non-fusible glass filaments. The extreme lighting end 180 also can comprise a mixture of non-smokable material and smokable materials 184, such as a mixture of granulated or powdered tobacco lamina and/or stems mixed with a non-woven glass filament material, or the type of glass filament and reconstituted tobacco configuration set forth in U.S. Pat. No. 5,065,776 to Lawson et al. Most preferably, extreme lighting end segments 180 comprising non-smokable materials 184 are short and highly porous or air permeable, in order that the smokable material 26 located downstream from that segment 180 can be readily lit using a match or a cigarette lighter.

For the foregoing embodiments, the smokable lighting end segment 22, the heat generation segment 35, the aerosol-generation segment 51, the mouth end piece 65, and various components of the foregoing, can be manufactured using conventional types of cigarette and cigarette component manufacturing techniques and equipment, or appropriately modified cigarette and cigarette component manufacturing equipment. That is, the various component parts and pieces can be processed and assembled into cigarettes using the conventional types of technologies known to those skilled in the art of the design and manufacture of cigarettes and cigarette components, and in the art of cigarette component assembly. See, for example, the types of component configurations, component materials, assembly methodologies and assembly technologies set forth in U.S. Pat. No. 5,052,413 to Baker et al.; U.S. Pat. No. 5,088,507 to Baker et al.; U.S. Pat. No. 5,105,838 to White et al.; U.S. Pat. No. 5,469,871 to Barnes et al.; and U.S. Pat. No. 5,551,451 to Riggs et al.; and U.S. Patent Application Pub. No. 2005/0066986 to Nestor et al., which are incorporated herein by reference in their entireties.

A manner or method for assembling a cigarette representative of one aspect of the present invention, such as a cigarette of the type described with reference to FIG. 2, can be manufactured using the following types of techniques. A tobacco rod including tobacco cut filler circumscribed by paper wrapper can be manufactured using conventional cigarette making machinery. For example, a continuous tobacco rod can be subdivided into a plurality of tobacco rods each having a length of 120 mm, and each such rod can be used as a "six-up" tobacco rod for the manufacture of the lighting end segments of six cigarettes. As such, the six-up rod can be subdivided transversely to its longitudinal axis into six segments, each having a length of 20 mm, using conventional types of tobacco rod cutting techniques. A continuous rod of extruded carbonaceous fuel element surrounded by a glass filament insulation jacket and circumscribed by an outer wrapping material. Such continuous rod also can be subdivided into short segments. For example, the continuous rod can be subdivided into a plurality of cylindrically shaped heat source segments, each having a length of 24 mm, and each such segment can be used as a "two-up" segment for the manufacture of the heat generation segments of two cigarettes. A smokable lighting end segment can be positioned at each end of a two-up heat generation segment. A circumscribing wrapper for the heat generation segment and at least a portion of the length of the smokable lighting end segment acts to provide a "two-up" combined segment. That two-up combined segment can be cut in half (i.e., transversely to the longitudinal axis of the combined segment, through the two-up heat source segment) to provide two combined segment pieces. A rod including processed tobacco filler incorporating glycerin circumscribed by wrapping material can be manufactured using conventional types of cigarette making machinery. The wrapping material preferably is a laminated material having on outer surface comprised of paper and an inner surface comprised of metal foil. For example, a continuous tobacco rod can be subdivided into a plurality of tobacco rods each having a length of 102 mm, and each such rod can be used as a "six-up" tobacco rod for the manufacture of the aerosol-generation segments of six cigarettes. As such, the six-up rod can be subdivided into three "two-up" cylindrically shaped segments, each having a length of 34 mm, using conventional types of tobacco rod cutting techniques. A previously provided combined segment can be positioned at each end of a two-up aerosol-generation segment. A circumscribing wrapper for the aerosol-generation segment and at least a portion of the length of the combined segment acts to provide a "two-up" cigarette rod. A preferred wrapper is a laminated material having on outer surface comprised of paper and an inner surface comprised of metal foil. That two-up cigarette rod can be cut in half (i.e., transversely to the longitudinal axis of the combined segment, through the two-up aerosol-generation segment) to provide two cigarette rods, each including three combined segment pieces. A "two-up" filter element segment can be manufactured using conventional types of filter making techniques. A previously provided cigarette rod can be positioned at each end of a two-up filter element segment. A circumscribing tipping material for the filter element segment and an adjacent region of the cigarette rod acts to provide a "two-up" filtered cigarette. That two-up cigarette can be cut in half (i.e., transversely to the longitudinal axis of the combined segment, through the two-up filter element) to provide two filtered cigarettes.

The manufacture of multi-segment components can be carried out using combination equipment of the type available under the brand name Mulfi from Hauni-Werke Korber & Co. KG of Hamburg, Germany. Combination of various segments or cigarette components also can be carried out using conventional-type or suitably modified devices, such as tipping devices available as Lab MAX, MAX, MAX S or MAX 80 from Hauni-Werke Korber & Co. KG. See, for example, the types of devices and combination techniques set forth in U.S. Pat. No. 3,308,600 to Erdmann et al.; U.S. Pat. No. 4,280,187 to Reuland et al.; U.S. Pat. No. 4,281,670 to Heitmann et al.; and U.S. Pat. No. 6,229,115 to Vos et al.

Figure 7:
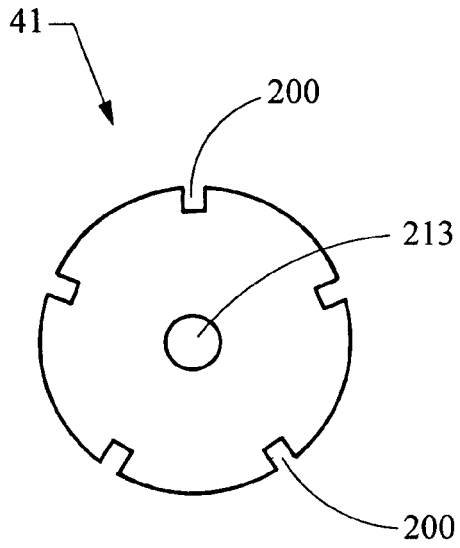
FIG. 7 shows an end view of a first embodiment of a fuel element that can be incorporated into smoking articles of the present invention.

Referring to FIG. 7, there is shown an end view of a first embodiment of a heat source, illustrated as a fuel element 41 that can be employed within the heat generation segment of a smoking article of the present invention. The fuel element 41 has a generally circular cross sectional shape. The fuel element can include several peripheral grooves 200 extending along its length. The fuel element 41 also includes at least one passageway 213 extending through its central region. For the embodiment shown, a representative fuel element can have an outermost diameter of about 4.2 mm; include five equally spaced peripheral slots or grooves, each having a depth of about 2 mm, and a maximum width of about 2 mm; and a central circular passageway having a diameter of about 0.027 mm, and extending through the center of the fuel element. In various embodiments, the grooves 200 may intersect or may remain parallel, and may form a set of straight lines along the surface of the fuel element 41, or may curve and even intersect each other along its surface.

Figure 8:
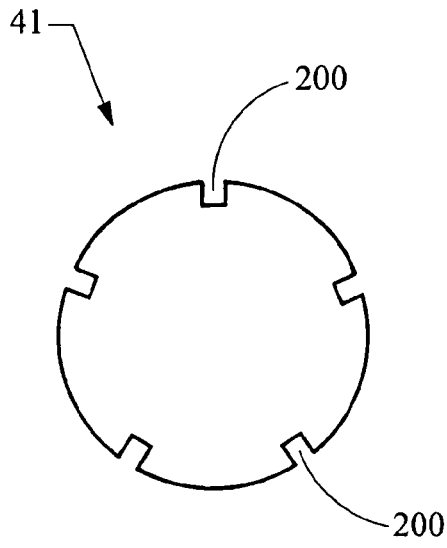
FIG. 8 shows an end view of a second embodiment of a fuel element that can be incorporated into smoking articles of the present invention.

Referring to FIG. 8, there is shown an end view of a second embodiment of a representative fuel element 41 that can be employed within the heat generation segment of a smoking article of the present invention. The fuel element 41 includes five peripheral grooves 200 extending along its. The fuel element does not include any passageway extending through its central region. For the embodiment shown, a representative fuel element can have an outermost diameter of about 3.8 mm; and include five equally spaced peripheral slots or grooves, each having a depth of about 1.52 mm, and a maximum width of about 0.56 mm.

Figure 9:
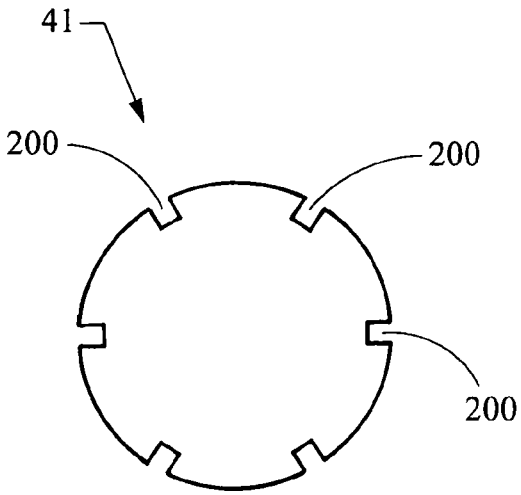
FIG. 9 shows an end view of a third embodiment of a fuel element that can be incorporated into smoking articles of the present invention.

Referring to FIG. 9, there is shown an end view of a third embodiment of a representative fuel element 41 that can be employed within the heat generation segment of a smoking article of the present invention. The fuel element 41 can include several peripheral grooves 200 extending along its length. The fuel element 41 does not include a centrally located, longitudinally extending passageway. For the embodiment shown, a representative fuel element can have an outermost diameter of about 3.8 mm; and include six equally spaced peripheral slots or grooves, each having a depth of about 2 mm, and a maximum width of about 2 mm.

Figure 10:
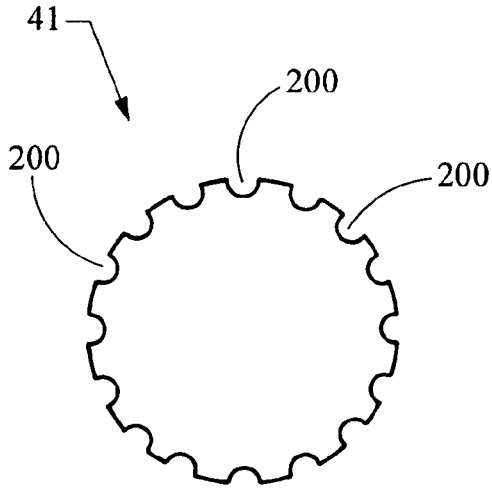
FIG. 10 shows an end view of a fourth embodiment of a fuel element that can be incorporated into smoking articles of the present invention.

Referring to FIG. 10, there is shown an end view of a fourth embodiment of a representative fuel element 41 that can be employed within the heat generation segment of a smoking article of the present invention. The fuel element 41 can include several peripheral grooves 200 extending along its length. The fuel element 41 does not include any passageway extending through its central region. For the embodiment shown, a representative fuel element can have an outermost diameter of about 3.8 mm; and include sixteen equally spaced peripheral slots or grooves, each having a depth of about 1 mm, and a maximum width of about 1 mm. The slots or grooves may provide a type of variegated appearance to the peripheral surface of the fuel element.

Smokable materials and other associated materials useful for carrying out certain aspects of the present invention can vary. Smokable materials are materials that can be incorporated into the smokable lighting end segment or rod, and provide mass and bulk to some region within that smokable lighting end segment. Smokable materials undergo some type of destruction during conditions of normal use of the smoking article into which they are incorporated. Destruction of the smokable material, due at least in part to thermal decomposition of at least some component of that smokable material, results in the formation of an aerosol having the form normally characterized as "smoke." For example, smokable materials incorporating tobacco materials are intended to burn, or otherwise undergo thermal decomposition, to yield tobacco smoke. The selection of tobacco types and tobacco blends can determine the chemical composition of, and the sensory and organoleptic characteristics of, that aerosol produced when that tobacco material or blend of tobacco materials is burned.

It is most highly preferred that smokable materials of the smokable lighting end segment incorporate tobacco of some form. Preferred smokable materials are composed predominantly of tobacco of some form, based on the dry weights of those materials. That is, the majority of the dry weight of those materials, and the majority of the weight of a mixture incorporating those materials (including a blend of materials, or materials having additives applied thereto or otherwise incorporated therein) are provided by tobacco of some form. For example, those materials can be processed tobaccos that incorporate minor amounts non-tobacco filler materials (e.g., calcium carbonate particles, carbonaceous materials, grains or wood pulp) and/or binding agents (e.g., guar gum, sodium alginate or ammonium alginate); and/or a blend of those materials can incorporate tobacco substitutes or extenders. Those materials, and blends incorporating those materials, frequently include greater than about 70 percent tobacco, often are greater than about 80 percent tobacco, and generally are greater than about 90 percent tobacco, on a dry weight basis, based on the combined weights of the tobacco, non-tobacco filler material, and non-tobacco substitute or extender. Those materials also can be primarily made all of tobacco material, and not incorporate any non-tobacco fillers, substitutes or extenders.

The smokable material can be treated with tobacco additives of the type that are traditionally used for the manufacture of cigarettes, such as casing and/or top dressing components. See, for example, U.S. Pat. No. 3,419,015 to Wochnowski; U.S. Pat. No. 4,054,145 to Berndt et al.; U.S. Pat. No. 4,887,619 to Burcham, Jr. et al.; U.S. Pat. No. 5,022,416 to Watson; U.S. Pat. No. 5,103,842 to Strang et al.; and U.S. Pat. No. 5,711,320 to Martin. Preferred casing materials include water, sugars and syrups (e.g., sucrose, glucose and high fructose corn syrup), humectants (e.g. glycerin or propylene glycol), and flavoring agents (e.g., cocoa and licorice). Those added components also include top dressing materials (e.g., flavoring materials, such as menthol). See, for example, U.S. Pat. No. 4,449,541 to Mays et al. Additives also can be added to the smokable materials using the types of equipment described in U.S. Pat. No. 4,995,405 to Lettau, or that are available as Menthol Application System MAS from Kohl Maschinenbau GmbH. The selection of particular casing and top dressing components is dependent upon factors such as the sensory characteristics that are desired, and the selection and use of those components will be readily apparent to those skilled in the art of cigarette design and manufacture. See, Gutcho, *Tobacco Flavoring Substances and Methods*, Noyes Data Corp. (1972) and Leffingwell et al., *Tobacco Flavoring for Smoking Products* (1972). The smokable material also may be treated, for example, with ammonia or ammonium hydroxide or otherwise treated to incorporate ammonia (e.g., by addition of ammonia salts such as, for example, diammonium phosphate). Preferably, the amount of ammonia optionally incorporated into the smokable material is less than about 5 percent, and generally about 1 to about 3 percent, based on the dry weight of the smokable material.

Smokable materials preferably are used in forms, and in manners, that are traditional for the manufacture of smoking articles, such as cigarettes. Those materials can incorporate shredded pieces of tobacco (e.g., as lamina and/or stem), and/or those materials can be tobacco materials that are in processed forms. For example, those materials normally are used in cut filler form (e.g., shreds or strands of tobacco filler cut into widths of about 1/10 inch to about 1/60 inch, preferably about 1/20 inch to about 1/35 inch, and in lengths of about 1/8 inch to about 3 inches, usually about 1/4 inch to about 1 inch). Alternatively, though less preferred, those materials, such as processed tobacco materials, can be employed as longitudinally extending strands or as sheets formed into the desired configuration, or as compressed or extruded pieces formed into a desired shape.

Tobacco materials can include, or can be derived from, various types of tobaccos, such as flue-cured tobacco, burley tobacco, Oriental tobacco or Maryland tobacco, dark tobacco, dark-fired tobacco and *Rustica* tobaccos, as well as other rare or specialty tobaccos, or blends thereof. Descriptions of various types of tobaccos, growing practices, harvesting practices and curing practices are set for in *Tobacco Production, Chemistry and Technology*, Davis et al. (Eds.) (1999). See, also, U.S. Patent Application Pub. No. 2004/0084056 to Lawson et al. Most preferably, the tobacco materials are those that have been appropriately cured and aged.

Preferably, tobacco materials are used in a so-called "blended" form. For example, certain popular tobacco blends, commonly referred to as "American blends," comprise mixtures of flue-cured tobacco, burley tobacco and Oriental tobacco. Such blends, in many cases, contain tobacco materials that have processed forms, such as processed tobacco stems (e.g., cut-rolled stems, cut-rolled-expanded stems or cut-puffed stems), volume expanded tobacco (e.g., puffed tobacco, such as dry ice expanded tobacco (DIET), preferably in cut filler form). Tobacco materials also can have the form of reconstituted tobaccos (e.g., reconstituted tobaccos manufactured using paper-making type or cast sheet type processes). Tobacco reconstitution processes traditionally convert portions of tobacco that normally might be wasted into commercially useful forms. For example, tobacco stems, recyclable pieces of tobacco and tobacco dust can be used to manufacture processed reconstituted tobaccos of fairly uniform consistency. The precise amount of each type of tobacco within a tobacco blend used for the manufacture of a particular cigarette brand can vary, is a manner of design choice, depending upon factors such as the sensory characteristics desired. See, for example, *Tobacco Encyclopedia*, Voges (Ed.) p. 44-45 (1984), Browne, *The Design of Cigarettes*, 3rd Ed., p. 43 (1990) and *Tobacco Production, Chemistry and Technology*, Davis et al. (Eds.) p. 346 (1999). Various representative tobacco types, processed types of tobaccos, types of tobacco blends, cigarette components and ingredients, and tobacco rod configurations, also are set forth in U.S. Pat. No. 4,836,224 to Lawson et al.; U.S. Pat. No. 4,924,883 to Perfetti et al.; U.S. Pat. No. 4,924,888 to Perfetti et al.; U.S. Pat. No. 5,056,537 to Brown et al.; U.S. Pat. No. 5,159,942 to Brinkley et al.; U.S. Pat. No. 5,220,930 to Gentry; U.S. Pat. No. 5,360,023 to Blakley et al.; U.S. Pat. No. 5,715,844 to Young et al.; and U.S. Pat. No. 6,730,832 to Dominguez et al.; U.S. Patent Application Pub. Nos. 2002/0000235 to Shafer et al.; 2003/0075193 to Li et al.; and 2003/0131859 to Li et al.; PCT Application Pub. No. WO 02/37990 to Bereman; U.S. Patent Application Pub. No. 2004/0084056 to Lawson et al.; U.S. Patent Application Pub. No. 2004/0255965 to Perfetti et al.; U.S. Patent Application Pub. No. 2005/0066986 to Nestor et al.; and Bombick et al., *Fund. Appl. Toxicol.*, 39, p. 11-17 (1997); which are incorporated herein by reference.

The fuel element of the heat generation segment can vary. Exemplary suitable fuel elements, and representative components, designs and configurations thereof, and manners and methods for producing those fuel elements and the components thereof, are set forth in U.S. Pat. No. 4,714,082 to Banerjee et al.; U.S. Pat. No. 4,756,318 to Clearman et al.; U.S. Pat. No. 4,881,556 to Clearman et al.; U.S. Pat. No. 4,989,619 to Clearman et al.; U.S. Pat. No. 5,020,548 to Farrier et al.; U.S. Pat. No. 5,027,837 to Clearman et al.; U.S. Pat. No. 5,067,499 to Banerjee et al.; U.S. Pat. No. 5,076,297 to Farrier et al.; U.S. Pat. No. 5,099,861 to Clearman et al.; U.S. Pat. No. 5,105,831 to Banerjee et al.; U.S. Pat. No. 5,129,409 to White et al.; U.S. Pat. No. 5,148,821 to Best et al.; U.S. Pat. No. 5,156,170 to Clearman et al.; U.S. Pat. No. 5,178,167 to Riggs et al.; U.S. Pat. No. 5,211,684 to Shannon et al.; U.S. Pat. No. 5,247,947 to Clearman et al.; U.S. Pat. No. 5,345,955 to Clearman et al.; U.S. Pat. No. 5,469,871 to Barnes et al.; U.S. Pat. No. 5,551,451 to Riggs; U.S. Pat. No. 5,560,376 to Meiring et al.; U.S. Pat. No. 5,706,834 to Meiring et al.; and U.S. Pat. No. 5,727,571 to Meiring et al.; and U.S. patent application Pub. No. Ser. No. 10/868,126, filed Jun. 15, 2004, to Banerjee et al.; which are incorporated herein by reference. Exemplary carbonaceous fuel elements are of the type that have been incorporated within those cigarettes commercially marketed under the trade names "Premier" and "Eclipse" by R. J. Reynolds Tobacco Company. Most preferably, each heat source segment incorporates a one piece fuel element, and only one fuel element is incorporated into each heat source segment. Certain preferred fuel elements are absent of longitudinally extending air passageways. Certain fuel elements can have a generally tubular shape; having a relatively large diameter central passageway and no peripherally extending grooves. Certain fuel elements have longitudinally extending peripheral grooves, and the grooves can have cross-section shapes of semi-circular, triangular or rectangular, or such that the overall cross-sectional shape of the fuel element can be characterized as generally "snow flake" in nature. Certain other fuel elements may have a surface that includes no grooves while optionally including a central passageway. Yet other fuel elements may have a surface that includes no grooves and are substantially solid (e.g., not having any central passageway).

Preferred fuel elements incorporate carbonaceous material. For example, the amount of carbonaceous material incorporated into a fuel element preferably provides at least about 50 percent, often at least about 60 percent, and frequently at least about 70 percent, of the weight of a fuel element, on a dry weight basis. Preferred representative fuel elements incorporate up to about 15 weight percent, frequently up to about 10 weight percent binding agent; up to about 15 weight percent, frequently up to about 10 weight percent of additive ingredients such as tobacco powder, salts, and the like; up to about 20 weight percent, frequently up to about 15 weight percent, of ingredients such as graphite or alumina; and at least about 50 weight percent, frequently at least about 65 weight percent, of a high carbon content carbonaceous material. Certain representative fuel elements incorporate about 10 to about 20 weight parts of ingredients such as graphite or alumina, and about 60 to about 75 weight parts of carbonaceous material.

The fuel element can be formed into the desired shape by techniques such as compression, pressing or extrusion. For example, a moist, dough-like paste can be extruded using single screw or twin screw extruder, such as an extruder having a stainless steel barrel and screw, an inner sleeve constructed from a highly wear resistant and corrosion resistant ceramic material, and a ceramic die. Exemplary types of extrusion devices include those types available as ICMA San Giorgio Model No. 70-16D or as Welding Engineers Model No. 70-16LD. For an extruded fuel element containing a relatively high level of carbonaceous material, the density of the fuel element can be decreased slightly by increasing the moisture level within the extruded mixture, decreasing the die pressure within the extruder, or incorporating relatively low density materials within the extruded mixture.

The fuel element most preferably is circumscribed or otherwise jacketed by insulation, or other suitable material. The insulation most preferably configured and employed so as to support, maintain and retain the fuel element in place within the smoking article. The insulation most preferably is adapted such that drawn air and aerosol can pass readily therethrough. Exemplary insulation materials, components of insulation assemblies, configurations of representative insulation assemblies within heat generation segments, wrapping materials for insulation assemblies, and manners and methods for producing those components and assemblies, are set forth in U.S. Pat. No. 4,807,809 to Pryor et al.; U.S. Pat. No. 4,893,637 to Hancock et al.; U.S. Pat. No. 4,938,238 to Barnes et al.; U.S. Pat. No. 5,027,836 to Shannon et al.; U.S. Pat. No. 5,065,776 to Lawson et al.; U.S. Pat. No. 5,105,838 to White et al.; U.S. Pat. No. 5,119,837 to Banerjee et al.; U.S. Pat. No. 5,247,947 to Clearman et al.; U.S. Pat. No. 5,303,720 to Banerjee et al.; U.S. Pat. No. 5,345,955 to Clearman et al.; U.S. Pat. No. 5,396,911 to Casey, III et al.; U.S. Pat. No. 5,546,965 to White; U.S. Pat. No. 5,727,571 to Meiring et al.; U.S. Pat. No. 5,902,431 to Wilkinson et al.; and U.S. Pat. No. 5,944,025 to Cook et al.; which are incorporated herein by reference. See, also, *Chemical and Biological Studies on New Cigarette Prototypes that Heat Instead of Burn Tobacco*, R. J. Reynolds Tobacco Company Monograph (1988). Exemplary insulation assemblies have been incorporated within the types of cigarettes commercially marketed under the trade names "Premier" and "Eclipse" by R. J. Reynolds Tobacco Company. A preferred insulation assembly is manufactured using at least one layer of non-woven glass filament mat. For example, a web of at least one layer of non-woven glass filament mat can be wrapped around a continuously extruded fuel element, the face of the mat can be moistened with water (e.g., by spraying) in order to facilitate binding of the fuel element to the mat, the resulting assembly can be circumscribed with a continuous paper web (e.g., using two continuous center line strips adhesive and a seam line adhesive, each of which optionally can contain flavoring agents or burn modifiers), and the resulting continuous rod can be cut into segments of the desired length. If desired, flavoring agents, burn modifiers, and the like, can be incorporated within the water that is applied to the glass filament mat.

Insulation assemblies can incorporate materials such as calcium sulfate fibers, thermal resistant ceramic filaments, high temperature resistant carbon filaments (e.g., graphite-type materials), and the like, which can be incorporated into non-woven mats. Representative insulation assemblies also can incorporate tobacco; such as particles or pieces of tobacco dispersed within a glass filament mat, or configured as at least one layer of reconstituted tobacco sheet with at least one layer of glass filament mat. Alternatively, though less preferred, paper-type materials (e.g., paper-type materials treated with appropriate salts, such as potassium chloride, in amounts sufficient to provide certain degrees of heat resistant characters thereto) can be gathered or crimped and gathered around the fuel element, in order to adequately hold the fuel element securely in place within the cigarette. Alternatively, though less preferred, tobacco cut filler (e.g., a shredded lamina, pieces of tobacco stems, shredded reconstituted tobacco paper-type sheet, shredded reconstituted tobacco cast sheet, or blends of the foregoing), which can be treated with appropriate salts, such as is set forth in U.S. Patent Application Pub. No. 2005/0066986 to Nestor et al., can surround the peripheral region of the fuel element, in order to adequately hold the fuel element securely in place within the cigarette. Representative types of tobacco materials can be manufactured from mixtures of tobacco types; or from one predominant type of tobacco (e.g., a cast sheet-type or paper-type reconstituted tobacco composed primarily of burley tobacco, or a cast sheet-type or paper-type reconstituted tobacco composed primarily of Oriental tobacco). Flavoring agents (e.g., volatile flavoring agents) can be incorporated within the insulation assembly, and as such, (i) flavor can be entrained within drawn aerosol that is produced by burning of the smokable material as that aerosol passes through the insulation assembly, and (ii) the flavor of aerosol produced by burning the fuel element of the heat generation segment can be enhanced.

The aerosol-forming material can vary, and mixtures of various aerosol-forming materials can be used. Representative types of aerosol-forming materials are set forth in U.S. Pat. No. 4,793,365 to Sensabaugh, Jr. et al.; and U.S. Pat. No. 5,101,839 to Jakob et al.; PCT Application Pub. No. WO 98/57556 to Biggs et al.; and *Chemical and Biological Studies on New Cigarette Prototypes that Heat Instead of Burn Tobacco*, R. J. Reynolds Tobacco Company Monograph (1988); which are incorporated herein by reference. A preferred aerosol-forming material produces a visible aerosol upon the application of sufficient heat thereto, and a highly preferred aerosol-forming material produces an aerosol that can be considered to be "smoke-like." A preferred aerosol-forming material is chemically simple, relative to the chemical nature of the smoke produced by burning tobacco. A highly preferred aerosol-forming material is a polyol, such as glycerin.

A variety of materials can be used to provide the material for that portion of the aerosol-generating region that acts as a substrate for the aerosol-forming material. Exemplary substrate materials, and exemplary formulations incorporating aerosol-forming materials, are set forth in U.S. Pat. No. 4,793,365 to Sensabaugh et al.; U.S. Pat. No. 4,893,639 to White; U.S. Pat. No. 5,099,861 to Clearman et al.; U.S. Pat. No. 5,101,839 to Jakob et al.; U.S. Pat. No. 5,105,836 to Gentry et al.; U.S. Pat. No. 5,159,942 to Brinkley et al.; U.S. Pat. No. 5,203,355 to Clearman et al.; U.S. Pat. No. 5,271,419 to Arzonico et al.; U.S. Pat. No. 5,327,917 to Lekwauwa et al.; U.S. Pat. No. 5,396,911 to Casey, III et al.; U.S. Pat. No. 5,533,530 to Young et al.; U.S. Pat. No. 5,588,446 to Clearman; U.S. Pat. No. 5,598,868 to Jakob et al.; and U.S. Pat. No. 5,715,844 to Young et al.; and U.S. Patent Application Pub. No. 2005/0066986 to Nestor et al.; which are incorporated herein by reference. See, also, *Chemical and Biological Studies on New Cigarette Prototypes that Heat Instead of Burn Tobacco*, R. J. Reynolds Tobacco Company Monograph (1988). Exemplary substrate materials have been incorporated within the types of cigarettes commercially marketed under the trade names "Premier" and "Eclipse" by R. J. Reynolds Tobacco Company.

The substrate material can incorporate tobacco of some form, normally is composed predominantly of tobacco, and can be provided by virtually all tobacco material. The form of the substrate material can vary; but most preferably that material is employed in an essentially traditional filler form (e.g., as cut filler). The substrate material can be otherwise formed into desired configurations. The substrate material can be used in the form of a gathered web or sheet, using the types of techniques generally set forth in U.S. Pat. No. 4,807,809 to Pryor et al. The substrate material can be used into the form of a web or sheet that is shredded into a plurality of longitudinally extending strands, using the types of techniques generally set forth in U.S. Pat. No. 5,025,814 to Raker. The substrate material can have the form of a loosely rolled sheet, such that a spiral type of air passageway extends longitudinally through the aerosol-generation segment. Representative types of tobacco containing substrate materials can be manufactured from mixtures of tobacco types; or from one predominant type of tobacco (e.g., a cast sheet-type or paper-type reconstituted tobacco composed primarily of burley tobacco, or a cast sheet-type or paper-type reconstituted tobacco composed primarily of Oriental tobacco).

The substrate material also can be treated with tobacco additives of the type that are traditionally used for the manufacture of cigarettes, such as casing and/or top dressing components. The substrate material optionally can be ammoniated (e.g., by treatment with anhydrous ammonia, aqueous ammonium hydroxide, or ammonium salts such as diammonium phosphate). Alternatively those materials can be absent, or virtually absent, of any type of added ammonia (e.g., whether by treatment with anhydrous ammonia, aqueous ammonium hydroxide, or ammonium salts such as diammonium phosphate). Those materials also can be treated with other additives, such as potassium carbonate or sodium bicarbonate. Other materials, such as catalytic agents, nanoparticle compositions, and the like, also can be incorporated within any of the smokable materials of the smokable rod. See, for example, the types of components set forth in US Pat. Publication 2004/0173229 to Crooks et al. Preferably, the material is not treated with more that about 10 percent of any of those types of additive agents other than aerosol-forming materials, based on the dry weight of tobacco material within that substrate material.

The manner by which the aerosol-forming material is contacted with the substrate material (e.g., the tobacco material) can vary. The aerosol-forming material can be applied to a formed tobacco material, or can be incorporated into processed tobacco materials during manufacture of those materials. The aerosol-forming material can be dissolved or dispersed in an aqueous liquid, or other suitable solvent or liquid carrier, and sprayed onto that substrate material. See, for example, U.S. Patent Application Pub. No. 2005/0066986 to Nestor et al. The amount of aerosol-forming material employed relative to the dry weight of substrate material can vary. Materials including exceedingly high levels of aerosol-forming material preferably can be difficult to process into cigarette rods using conventional types of automated cigarette manufacturing equipment.

Cast sheet types of materials preferably can incorporate relatively high levels aerosol-forming material. Reconstituted tobaccos manufactured using paper-making types of processes preferably can incorporate moderate levels of aerosol-forming material. Tobacco strip and tobacco cut fuller can incorporate lower amounts of aerosol-forming material. For processed materials, such as cast sheet materials and paper-type reconstituted tobaccos, tobacco pulp materials that are extracted with aqueous liquids can be used as components thereof. The removal of some fraction or essentially all of the water soluble components of tobacco can assist in providing a processed material that is capable of acting as an effective substrate for higher levels of aerosol-forming material. In addition, dusting processed materials with dry tobacco powders can assist in providing processed materials having relatively high levels of glycerin while not demonstrating overly tacky or sticky characteristics.

Cast sheet materials, and particularly cast sheet materials incorporating certain amounts of tobacco pulp materials that have been extracted with water, often can comprise up to about 65 percent, often up to about 60 percent, and frequently up to about 55 percent, aerosol-forming material, based on the dry weight of the tobacco and aerosol-forming material in the material so produced. Paper-type reconstituted tobacco materials, and particularly those materials incorporating certain amounts of tobacco pulp materials that have been extracted with water, and not reapplying some or all of the water soluble extract components back to that pulp, often can comprise up to about 55 percent, often up to about 50 percent, and frequently up to about 45 percent, aerosol-forming material, based on the dry weight of the tobacco and aerosol-forming material in the material so produced. A material produced by spraying tobacco strip or cut filler with aerosol-forming material often does not comprise more than about 20 percent, and frequently does not comprise more than about 15 percent, aerosol-forming material, based on the dry weight of the tobacco and aerosol-forming material of the material so produced. Materials having relatively high loading levels of aerosol-forming material can be dried (e.g., by being subjected to a flow of hot air) to a moisture content of about 4 percent to about 5 percent, by weight; the dried material then can be processed to form the components of the designed configuration; and then those components can be re-equilibrated to a moisture content of about 12 to about 13 weight percent.

Other types of materials incorporating relatively high levels of aerosol-forming material can be incorporated in the aerosol-generation segment 51. Formed, encapsulated or microencapsulated materials can be employed. Such types of materials preferably include primarily of aerosol-forming material, and those materials can incorporate some amount and form of tobacco. An example of such a type of material is a film produced by casting and drying an aqueous solution of about 65 to about 70 weight parts glycerin, and about 25 to about 30 weight parts binder (e.g., citrus pectin, ammonium alginate, sodium alginate or guar gum), and about 5 weight parts flavoring agent (e.g., vanillin, coffee, tea, cocoa and/or fruit flavor concentrates); and then surface-coating that film with about 2 to about 10 weight parts of a finely divided powder that is provided by milling tobacco lamina.

The amount of aerosol-forming material that is used within the aerosol-generation segment 51 is such that the cigarette exhibits acceptable sensory and organoleptic properties, and desirable performance characteristics. For example, it is highly preferable that sufficient aerosol-forming material, such as glycerin, be employed in order to provide for the generation of a visible mainstream aerosol high in many regards resembles the appearance of tobacco smoke. It is desirable for those components not to introduce significant degrees of unacceptable off-taste, filmy mouth-feel, or an overall sensory experience that is significantly different from that of a traditional type of cigarette that generates mainstream smoke by burning tobacco cut filler. The selection of the components, the amounts of those components used, and the types of tobacco material used, can be altered in order to control the overall chemical composition of the mainstream aerosol produced by the cigarette.

Other types of flavoring agents, or materials that alter the sensory or organoleptic character or nature of the mainstream aerosol of the cigarette, can be employed. Such flavoring agents can be provided from sources other than tobacco, can be natural or artificial in nature, and can be employed as concentrates or flavor packages. Of particular interest are flavoring agents that are applied to, or incorporated within, the substrate material of the aerosol-generation segment. Exemplary flavoring agents include vanillin, ethyl vanillin, cream, tea, coffee, fruit (e.g., apple, cherry, strawberry, peach and citrus flavors, including lime and lemon), maple, menthol, mint, peppermint, spearmint, wintergreen, nutmeg, clove, lavender, cardamom, ginger, honey, anise, sage, cinnamon, sandalwood, jasmine, cascarilla, cocoa, licorice; and flavorings and flavor packages of the type and character traditionally used for the flavoring of cigarette and pipe tobaccos. Syrups, such as high fructose corn syrup, also can be employed. Flavoring agents also can include acidic or basic characteristics (e.g., organic acids, such as levulinic acid). Preferably, such flavoring agents constitute less than about 10 percent, and often less than about 5 percent of the total weight of aerosol-generation segment, on a dry weight basis.

The wrapping materials can vary. Exemplary types of wrapping materials for the heat generation segment are set forth in U.S. Pat. No. 4,938,238 to Barnes et al. and U.S. Pat. No. 5,105,837 to Barnes et al. Wrapping materials, such as those set forth in U.S. Patent Application Pub. No. 2005/0005947 to Hampl, Jr. et al. and PCT Application Pub. No. WO 2005/039326 to Rasouli et al., can be employed as inner wrapping materials of a so-called "double wrap" configuration of a heat generation segment. An exemplary type of heat conductive wrapping material for the aerosol-generation segment 51 is set forth in U.S. Pat. No. 5,551,451 to Riggs et al. Other suitable wrapping materials are set forth in U.S. Pat. No. 5,065,776 to Lawson et al. and U.S. Pat. No. 6,367,481 to Nichols et al. Exemplary wrapping materials, such as laminates of paper and metal foil, and papers used as the outer circumscribing wrapper of the heat generation segment, have been incorporated within the types of cigarettes commercially marketed under the trade names "Premier" and "Eclipse" by R. J. Reynolds Tobacco Company. If desired, outer wrapping materials of the aerosol-generation segment 51 (e.g., those wrapping materials circumscribing the aerosol-generation as well as adjacent regions) optionally can be treated with heat sensitive materials (e.g., heat sensitive inks) that provide color change when the cigarette is being used, in order that the smoker can visually identify the regions of the cigarette that are experiencing increased temperature relative to ambient temperature.

A preferred wrapping material for a component such as the smokable lighting end segment is a paper material, such as the type of paper material preferably used in cigarette manufacture. The selection of a particular wrapping material will be readily apparent to those skilled in the art of cigarette design and manufacture. Smokable lighting end segments can include one layer of wrapping material; or those segments can have more than one layer of circumscribing wrapping material, such as is the case for the so-called "double wrap" smokable rods. The wrapping material can be made of materials, or be suitably treated, in order that the wrapping material does not experience a visible spotting and staining as a result of contact with various components contained within the cigarette. Exemplary types of wrapping materials, wrapping material components and treated wrapping materials are described in U.S. Pat. No. 5,105,838 to White et al.; U.S. Pat. No. 5,271,419 to Arzonico et al.; U.S. Pat. No. 5,220,930 to Gentry and U.S. Pat. No. 6,874,508 to Shafer et al.; PCT Application Pub. No. WO 01/08514 to Fournier et al.; PCT Application Pub. No. WO 03/043450 to Hajaligol et al.; U.S. Patent Application Pub. No. 2003/0114298 to Woodhead et al.; and U.S. Patent Application Pub. No.s 2004/0134631 to Crooks et al.; 2005/0005947 to Hampl, Jr. et al.; 2005/0016556 to Ashcraft et al.; and 2005/0076929 to Fitzgerald et al.; and PCT Application Pub. No. WO 2005/039326 to Rasouli et al.; which are incorporated herein by reference in their entireties. Representative wrapping materials are commercially available as R. J. Reynolds Tobacco Company Grades 119, 170, 419, 453, 454, 456, 465, 466, 490, 525, 535, 557, 652, 664, 672, 676 and 680 from Schweitzer-Mauduit International. Colored wrapping materials (e.g., brown colored papers) can be employed. Reconstituted tobacco materials also can be used, particularly as inner wrapping materials (e.g., in regions that are over-wrapped with at least one further layer of wrapping material), and representative reconstituted tobacco materials useful as wrapping materials for smokable rods are set forth in U.S. Pat. No. 5,074,321 to Gentry et al.; U.S. Pat. No. 5,159,944 to Arzonico et al.; U.S. Pat. No. 5,261,425 to Raker; U.S. Pat. No. 5,462,073 to Bowen; and U.S. Pat. No. 5,699,812 to Bowen; which are incorporated herein by reference. The inner wrapping material also can be a cast sheet type of reconstituted tobacco material, including such a material incorporating a relatively high level of aerosol-forming material.

The mouth end piece can vary. Preferred mouth end pieces have the form of filter elements. The filter elements can be of a one segment or multi-segment design. Representative filter element components, designs and assemblies are described in Browne, *The Design of Cigarettes,* 3rd Ed. (1990); *Tobacco Production, Chemistry and Technology*, Davis et al. (Eds.) 1999; U.S. Pat. No. 4,508,525 to Berger; U.S. Pat. No. 4,807,809 to Pryor et al.; U.S. Pat. No. 4,903,714 to Barnes et al.; U.S. Pat. No. 4,920,990 to Lawrence et al.; U.S. Pat. No. 5,012,829 to Thesing et al.; U.S. Pat. No. 5,025,814 to Raker; U.S. Pat. No. 5,074,320 to Jones, Jr. et al.; U.S. Pat. No. 5,076,295 to Saintsing et al.; U.S. Pat. No. 5,101,839 to Jakob et al.; U.S. Pat. No. 5,105,834 to Saintsing et al.; U.S. Pat. No. 5,105,838 to White et al.; U.S. Pat. No. 5,271,419 to Arzonico et al.; U.S. Pat. No. 5,137,034 to Perfetti et al.; U.S. Pat. No. 5,360,023 to Blakley et al; U.S. Pat. No. 5,396,909 to Gentry et al.; U.S. Pat. No. 6,595,218 to Koller et al.; U.S. Pat. No. 5,718,250 to Banerjee et al.; U.S. Pat. No. 6,537,186 to Veluz; U.S. Pat. No. 6,530,377 to Lesser et al.; U.S. Pat. No. 6,615,842 to Cerami et al.; U.S. Pat. No. 6,631,722 to MacAdam et al.; and U.S. Pat. No. 6,792,953 to Lesser et al.; U.S. Patent Application Pub. No.s 2002/0014453 to Lilly, Jr. et al.; 2002/0020420 to Xue et al.; 2002/0166563 to Jupe et al.; 2003/0154993 to Paine et al.; 2003/0168070 to Xue et al.; 2004/0261807 to Dube et al.; 2005/0066983 to Clark et al.; 2005/0133051 to Luan et al.; and 2005/0133052 to Fournier et al.; U.S. patent application Ser. No. 10/901,662, filed Jul. 29, 2004, to Gonterman et al.; and PCT Application Pub. No. WO 02/37990 to Bereman. Representative filter materials can be manufactured from tow materials (e.g., cellulose acetate or polypropylene tow) or gathered web materials (e.g., gathered webs of paper, reconstituted tobacco, cellulose acetate, polypropylene or polyester). Certain filter elements can have relatively high removal efficiencies for selected gas phase components of the mainstream aerosol. Certain filter elements can have relatively low filtration efficiencies for the volatilized aerosol-forming material. Exemplary mouth end piece assemblies have been incorporated within the types of cigarettes commercially marketed under the trade names "Premier" and "Eclipse" by R. J. Reynolds Tobacco Company.

The plug wrap and tipping material used to construct the mouth end piece and attach the mouth end piece to the remainder of the smoking article can vary. Exemplary plug wrap papers are available from Schweitzer-Mauduit International as Porowrap Plug Wrap 17-M1, 33-M1, 45-M1, 65-M9, 95-M9, 150-M4, 260-M4 and 260-M4T; and from Olsany Facility (OP Paprina) of the Czech Republic (Trierenberg Holding) as Ref. No. 646. Suitable plug wrap and tipping materials have been incorporated within the types of cigarettes commercially marketed under the trade names "Premier" and "Eclipse" by R. J. Reynolds Tobacco Company.

For cigarettes of the present invention that are air diluted or ventilated, the amount or degree of air dilution or ventilation can vary. Frequently, the amount of air dilution for an air diluted cigarette is greater than about 10 percent, generally is greater than about 20 percent, often is greater than about 30 percent, and sometimes is greater than about 40 percent. Preferably, the upper level for air dilution for an air diluted cigarette is less than about 80 percent, and often is less than about 70 percent. As used herein, the term "air dilution" is the ratio (expressed as a percentage) of the volume of air drawn through the air dilution means to the total volume and air and aerosol drawn through the cigarette and exiting the mouth end portion of the cigarette. Higher air dilution levels can act to reduce the transfer efficiency of aerosol-forming material into mainstream aerosol.

Preferred cigarettes of the present invention exhibit desirable resistance to draw. For example, an exemplary cigarette exhibits a pressure drop of between about 50 and about 200 mm water pressure drop at 17.5 cc/sec. air flow. Preferred cigarettes exhibit pressure drop values of between about 60 mm and about 180, more preferably between about 70 mm to about 150 mm, water pressure drop at 17.5 cc/sec. air flow. Preferably, pressure drop values of cigarettes are measured using a Filtrona Cigarette Test Station (CTS Series) available form Filtrona Instruments and Automation Ltd.

Cigarettes of the present invention, when smoked, yield an acceptable number of puffs. Such cigarettes normally provide more than about 6 puffs, and generally more than about 8 puffs, per cigarette, when machine smoked under FTC smoking conditions. Such cigarettes normally provide less than about 15 puffs, and generally less than about 12 puffs, per cigarette, when smoked under FTC smoking conditions. FTC smoking conditions consist of 35 ml puffs of 2 second duration separated by 58 seconds of smolder. The number of puffs attributed principally to the burning of the smokable lighting end segment of smokable material preferably ranges from about 1 to about 5 per cigarette, generally about 2 to about 4 per cigarette, when the cigarette is smoked under FTC smoking conditions. The number of puffs attributed principally to the operation of the aerosol-generation system generally ranges from about 5 to about 12 per cigarette, when the cigarette is smoked under FTC smoking conditions.

Cigarettes of the present invention, when smoked, yield mainstream aerosol. The amount of mainstream aerosol that is yielded per cigarette can vary. When smoked under FTC smoking conditions, an exemplary cigarette yields an amount of FTC "tar" that normally is at least about 1 mg, often is at least about 3 mg, and frequently is at least about 5 mg. When smoked under FTC smoking conditions, an exemplary cigarette yields an amount of FTC "tar" that normally does not exceed about 20 mg, often does not exceed about 15 mg, and frequently does not exceed about 12 mg.

A preferred cigarette exhibits a ratio of yield of FTC "tar" to FTC nicotine of less than about 30, and often less than about 25. A preferred cigarette exhibits a ratio of yield of FTC "tar" to FTC nicotine of more than about 5. A preferred cigarette (e.g., a cigarette including a carbonaceous fuel element absent of a centrally or internally located longitudinally extending air passageway) exhibits a ratio of yield of FTC carbon monoxide to FTC "tar" of less than about 1, often less than about 0.8, and frequently less than about 0.6. Techniques for determining FTC "tar" and FTC nicotine are set forth in Pillsbury et al., *J. Assoc. Off. Anal. Chem.,* 52, 458-462 (1969). Techniques for determining FTC carbon monoxide are set forth in Horton et al., *J. Assoc. Off. Anal. Chem.,* 57, 1-7 (1974).

Aerosols that are produced by cigarettes of the present invention are those that comprise air-containing components such as vapors, gases, suspended particulates, and the like. Aerosol components can be generated from burning tobacco of some form (and optionally other components that are burned to generate heat); by thermally decomposing tobacco caused by heating tobacco, smoldering tobacco, and charring tobacco; and by vaporizing aerosol-forming agent. As such, the aerosol can contain volatilized components, combustion products (e.g., carbon dioxide and water), incomplete combustion products, and products of pyrolysis. Aerosol components may also be generated by the action of heat from burning tobacco of some form (and optionally other components that are burned to generate heat), upon substances that are located in a heat exchange relationship with tobacco material that is burned and other components that are burned. Aerosol components may also be generated by the aerosol-generation system as a result of the action of heat of the heat generation segment upon an aerosol-generation segment 51. Most preferably, components of the aerosol-generation segment 51 have an overall composition, and are positioned within the smoking article, such that those components have a tendency not to undergo a significant degree of thermal decomposition (e.g., as a result of combustion, smoldering or pyrolysis) during conditions of normal use.

The amount of aerosol-forming material within the mainstream smoke of a cigarette of the present invention can vary. For preferred cigarette mainstream smoke condensate that is collected during smoking, the amount of aerosol-forming material within that condensate usually makes up at least about 30 percent, generally at least about 40 percent, frequently at least about 50 percent, often at least about 60 percent, and sometimes at least about 70 percent, of the total dry weight thereof. For condensate that is collected, the amount of aerosol-forming material within that condensate preferably makes up less than about 90 percent, and generally less than about 85 percent, frequently less than about 75 percent, of the total dry weight thereof. See, for example, Laurene et al., *Tob. Sci.,* 9: 1-4 (1965). The overall mainstream aerosol produced by a cigarette of the present invention comprises reduced amounts of certain incomplete products of combustion and pyrolysis products derived from the burning of substances such as tobacco cut filler, and other thermal degradation products of tobacco, as compared to the mainstream smoke produced entirely by burning conventional blends of tobacco cut filler in traditional types of commercially popular tobacco burning cigarettes.

A highly preferred cigarette of the present invention is capable of providing mainstream aerosol including, at least to some extent, the desirable sensory characteristics traditionally associated with tobacco smoke incorporating those incomplete combustion products, pyrolysis products, and other thermal degradation products associated with the burning of tobacco. A preferred cigarette produces mainstream aerosol that can be characterized as highly flavorful and as having a relatively great degree of strength. The selection of certain cultivars (e.g., by employing burley tobacco and/or certain amounts of Prelip, Bafra, Samsun and Agonya types of Oriental tobaccos), and incorporating those tobaccos in relevant regions of the cigarettes (e.g., into the aerosol-generation segment 51*s* of those cigarettes) can be used as a means to provide flavorful mainstream aerosol. For example, a substrate material of the aerosol-generation segment can be manufactured from about 50 weight parts of a cast sheet-type of reconstituted tobacco manufactured from a blend of flavorful tobaccos and added flavors, and about 50 weight parts of a cast sheet-type of reconstituted tobacco manufactured from about 90 weight parts burley tobacco and about 10 weight parts Prelip type Oriental tobacco. Burley tobacco can be incorporated within the cigarette, particularly within the smokable material at the lighting end of the cigarette. The insulation assembly can incorporate a sandwiched sheet or gathered web of a cast sheet-type of reconstituted tobacco material incorporating about 35 weight parts burley tobacco, about 23.5 parts flue-cured tobacco, about 15 weight parts alginate binder, about 13 weight parts glycerin, about 12 weight parts wood pulp and about 1.5 weight parts potassium hydroxide. Suitably selected of upper stalk leaves from flue-cured, burley and Oriental tobaccos also can be incorporated into cigarettes in relevant regions in order to provide flavorful mainstream aerosol. Thus, a smoker can be provided with mainstream aerosol including a desirably high degree of tobacco flavor, organoleptic sensations and satisfaction, while ingesting a significantly reduced overall amount of smoke generated by the burning of tobacco. Flavorings and flavor packages can provide flavor, strength and body to an aerosol that might be otherwise perceived as having overall sensory attributes that can be characterized as being overly bland, weak, mild or unsatisfying, or as otherwise having negative sensory attributes.

EXPERIMENTAL

The following prophetic examples are provided in order to further illustrate various aspects of the invention but should not be construed as limiting the scope thereof. Unless otherwise noted, all parts and percentages are by weight.

Example 1

A cigarette of the general type described previously with reference to FIG. 1 is provided. The cigarette has an overall length of about 84 mm. The cigarette includes a smokable lighting end segment having a length of about 21 mm at one end, and a mouth end piece having a length of about 34 mm at the other end. The cigarette also includes a heat generation segment having a length of about 12 mm adjacent the smokable lighting end segment, and an aerosol-generation segment having a length of about 17 mm positioned adjacent the filter element. When viewed end on, the cigarette has a generally circular cross-sectional shape. The circumference of the cigarette is about 24.6 mm.

The smokable lighting end segment has a generally cylindrical shape, and is produced by wrapping the smokable material in a wrapping material. The wrapping material circumscribes the smokable material such that the wrapping material and smokable material each extend along the total length of the segment. The wrapping material provides the outer longitudinal surface for the segment, and due to the resulting tubular shape of the wrapping material, each end of the segment is open to expose the smokable material thereof. The wrapping material is a combustible paper wrapper comprising wood pulp and calcium carbonate. The paper wrapping material has a dry basis weight of about 45 g/m$^2$, a porosity of about 21 CORESTA units, and is available as Reference No. 445 from RFS Ecusta Inc.

The smokable material of the smokable lighting end segment is a blend of various types of tobaccos and processed tobaccos, and is the type of blend known as an "American blend." The blend is that type of cased and top dressed tobacco cut filler blend used by R. J. Reynolds Tobacco Company for the manufacture of cigarettes that are commercially available under the brand name "Camel Turkish Gold." Each of the cut filler materials are shredded materials that are cut into pieces at about 28 cuts per inch. Except for the casing and top dressing components that have been applied thereto, the blend is a smokable material that consists primarily of tobacco, and no tobacco substitutes, non-tobacco fillers or non-tobacco extenders are used in the blend or within processed tobaccos of the blend. The moisture content of the tobacco cut filler blend of the inner rod is about 12 percent to about 13 percent. The cased and top dressed smokable material within the smokable lighting end segment weighs about 350 mg.

The aerosol-generation segment has a generally cylindrical shape. A wrapping material circumscribes a processed tobacco material having glycerin incorporated therein. The wrapping material and processed tobacco material each extend along the total length of the segment. The wrapping material provides the outer longitudinal surface for the segment, and due to the resulting tubular shape of the wrapping material, each end of the segment is open to expose the processed tobacco material thereof. The wrapping material is a laminate of paper and metal foil. A representative paper of the laminate is available as Reference No. 445 from RFS Ecusta Inc., and aluminum foil having a thickness about 0.0005 mm is adhered to one side thereof. The aluminum foil side of the laminate provides the inner surface of the wrapping material (i.e., the surface that contacts the processed tobacco material). The aerosol-generation segment is the type of segment that is positioned adjacent the heat source within the cigarette marketed under the brand name "Eclipse." The processed tobacco material within the segment weighs about 275 mg.

The processed tobacco material is provided by forming an aqueous slurry of about 6 parts ammonium alginate, about 58 parts glycerin, about 29 parts of a paper-type reconstituted tobacco manufactured from water extracted burley tobacco (and hence including essentially no water soluble extract portion), about 4 parts diammonium phosphate, and about 3 parts of finely milled particles of burley tobacco lamina. The slurry is mixed and is cast as a sheet, and heat is applied to dry the cast slurry to a moisture content of about 12 to about 13 percent. During casting of the slurry, a top load of finely divided particles of burley tobacco lamina is applied to the sheet, such that the final sheet incorporates about 90 parts of the slurry components and about 10 parts of the milled burley tobacco lamina, on a dry weight basis. The resulting processed tobacco material includes about 51 percent glycerin, on a dry weight basis.

The heat generation segment has a generally cylindrical shape. Combustible wrapping material circumscribes an insulating jacket that circumscribes a carbonaceous heat source. The heat generation segment is that type of segment used by R. J. Reynolds Tobacco Company for the manufacture of cigarettes that are commercially available under the brand name "Eclipse." The wrapping material provides the outer longitudinal surface of the segment, and end of the segment is open to expose the intermediate insulation region and the inner fuel element. A representative wrapping material is a paper material available as Reference No. 445 from RFS Ecusta Inc. The insulating jacket incorporates two layers of non-woven glass filament mat, each layer positioned on each side of a central layer of a reconstituted tobacco paper containing about 75 parts tobacco parts and about 25 parts wood pulp that is available as GSR265M2 from Schweitzer-Mauduit International. Each glass filament mat exhibits a caliper of about 0.75 mm to about 0.9 mm, and a basis weight of about 134 g/m$^2$ to about 1.54 g/m$^2$. The carbonaceous fuel element has an outer diameter of about 4.2 mm.

The carbonaceous fuel element is provided by providing a mixture of about 77.5 parts milled carbon powder, about 6.5 parts graphite, about 5 parts milled low tobacco specific nitrosamine content tobacco burley lamina, about 10 parts guar gum; about 1 part sodium carbonate; and sufficient water to provide an overall mixture having a moisture content of about 12 percent. The carbon is a type that is obtained from Calgon Carbon Inc., and can be characterized as a type BKO coconut base calcined at about 950° C. that has a moisture content of about 2 percent, an ash content of about 2.5 percent, and a surface area of less than 220 g/m$^2$. The graphite is a type of graphite available as Grade 5539A or 5539AF from Superior Graphite Company. The resulting mixture, which resembles a powder, is fed into a twin screw type extruder along with sufficient water to provide an overall mixture having a moisture content of about 34.5 percent. The extruder is equipped with a water jacket in order that the extruder can be maintained at about 27° C. The resulting mixture is extruded at so as to produce a continuous extrudate having a cross-sectional shape set forth in FIG. 7. The fuel element includes five longitudinally-extending, peripheral slots, each having a width of about 0.56 mm and a depth of about 0.75 mm. The central passageway that extends through the fuel element has a diameter of about 0.7 mm.

The continuous extrudate is conveyed on an air foil conveyor. The extrudate is circumscribed by a 19 mm wide web of non-woven glass filament mat, a 15 mm wide web of tobacco paper, a 19 mm wide web of non-woven glass filament mat, and on outer layer of wrapping paper. The construction of the continuous heat source assembly is performed using a PROTOS type of garniture on a KDF-2 type of rod making apparatus. Each of the PROTOS and KDF-2 types of cigarette component making equipment are available through Hauni-Werke Korber & Co. KG. The continuous rod is subdivided into rods each having lengths of about 72 mm. Air is blown over the assemblies, and the rods are further subdivided into fuel element segments, each of about 12 mm in length. Each fuel element assembly is attached to an aerosol-generation segment assembly, and the resulting assemblies are slowly dried. The assemblies are heated to about 47° C., and then to about 57° C. The assemblies preferably are not heated above about 65° C. After about 4 hours, the fuel element exhibits a moisture content of about 5 percent to about 8 percent, preferably about 6 percent to about 7 percent; and the substrate material of the aerosol-generation assembly exhibits a moisture content of about 10 percent to about 16 percent, preferably about 12 percent to about 14 percent. The assemblies are stored under conditions of 24.5° C. and about 60 percent relative humidity.

The four segments are aligned in an abutting, end-to-end relationship. A circumscribing layer of tipping paper and adhesive is used to connect the smokable lighting end segment to the heat generation segment. The tipping material is a tipping paper available as FEP 2836 from RFS Ecusta Inc. That is, a strip of tipping paper of about 27 mm width overlies the back 3 mm to 4 mm of the smokable lighting end segment and the front 3 mm to 4 mm of the heat generation segment. A circumscribing layer of wrapping material is used to connect the heat generation segment to the aerosol-generation segment. That is, a strip of the aluminum foil laminated paper overlies the back 4 mm of the heat generation segment and the full length of the aerosol-generation segment. The filter element and the aerosol-generation segment are secured together using the tipping paper. The tipping material circumscribes the length of the filter element and about 3 mm to about 4 mm of the length of the adjacent region of the heat generation segment.

A ring of laser perforations is provided around the periphery of the cigarette about 13 mm from the mouth end thereof. The perforations penetrate through the tipping paper and underlying wrapping material, and are provided using a Laboratory Laser Perforator from Hauni-Werke Korber & Co. KG. Each perforated cigarette is about 24 percent air diluted.

The side seam adhesive that is used for constructing the various segments, and for assembling the various segments together, can be that type of cigarette seam adhesive employed by R. J. Reynolds Tobacco Company and designated as CS-1242. See, for example, U.S. Patent Application Pub. No. 2004/0099279 to Chapman et al.

The tipping adhesive used for assembling the various segments together can be the type of water based, vinylacetate ethylene-based tipping adhesive employed by R. J. Reynolds Tobacco Company and designated as MT-8027.

Example 2

A cigarette of the general type described previously with reference to FIG. 1 is provided in the general manner set forth in Example 1. However, the mouth end segment has a length of about 10 mm. The aerosol-generation segment has a length of about of about 40 mm, and the processed tobacco material within the aerosol-generation segment weighs about 525 mg.

The mouth end segment has a generally cylindrical shape. A paper wrapping material circumscribes a steam bonded cellulose acetate tube manufactured by Filtrona plc. The central passageway of the tubular filter element is generally circular, and is about 4 mm in diameter. The mouth end segment generally is a filter element of the type incorporated within the cigarette marketed under the brand name "Eclipse."

Example 3

A cigarette of the general type described previously with reference to FIG. 1 is provided in the general manner set forth in Example 2. However, the fuel element of the heat generation segment is replaced with a fuel element that is provided as follows:

The carbonaceous fuel element is essentially of the type set forth in Example 1, and is provided using techniques and materials essentially of the type set forth in Example 1, however, the fuel element is absent of a central passageway, and has a cross-sectional shape generally of the type set forth in FIG. 8.

Example 4

A cigarette of the general type described previously with reference to FIG. 1 is provided in the general manner set forth in Example 3. However, the paper wrapper of the heat generation segment is replaced with a calcium carbonate and wood pulp cigarette paper wrapping material having a porosity of about 60 CORESTA units and a basis weight of about 29 g/m$^2$ that is of a type available as P4495-173-6 (Grade 615) from Schweitzer-Mauduit International.

Example 5

A cigarette of the general type described previously with reference to FIG. 4 is provided. The aerosol-generation system and the mouth end piece are provided in the general manner set forth in Example 1. However, the smokable lighting end segment is provided by removing the fuel element from a heat source segment of the type used for the manufacture of the aerosol-generation system, and replacing the fuel element with a 12 mm segment of tobacco cut filler wrapped circumscribed with a paper wrapper. The paper wrapped tobacco cut filler segment is cut from the tobacco rod of a cigarette having a circumference of about 17 mm that is available under the brand name "Capri" by R. J. Reynolds Tobacco Company. As such, the cigarette includes a 12 mm long segment of an insulated rod of tobacco cut filler, and an abutting 12 mm long heat generation segment.

Example 6

A cigarette of the general type manufactured for commercial sale under the brand name "Eclipse" by R. J. Reynolds Tobacco Company is provided. However, rather than providing a ring of air dilution perforations about 13 mm from the mouth end of the cigarette, a ring of air dilution perforations is located about 44 mm from the mouth end of the cigarette. In addition, a cylindrical smokable lighting end segment generally of the type described in Example 1, but having a length of about 16 mm is positioned and secured upstream of the heat source segment generally in the manner set forth in Example 1, so as to abut the front face of the heat source segment and provide a lighting end to the resulting segment. The resulting cigarette has an overall length of about 99 mm.

Example 7

A cigarette of the general type manufactured for commercial sale under the brand name "Premier" by R. J. Reynolds Tobacco Company is provided. However, a cylindrical smokable lighting end segment generally of the type described in Example 6 is positioned and secured upstream of the heat source segment generally in the manner set forth in Example 1, so as to abut the front face of the heat source segment and provide a lighting end to the resulting cigarette.

Example 8

A cigarette of the general type described previously with reference to FIG. 1 is provided in the general manner set forth in Example 1. However, the fuel element of the heat generation segment is replaced with a fuel element that is provided as follows:

The carbonaceous fuel element is essentially of the type set forth in Example 2, and is provided using techniques and materials essentially of the type set forth in Example 1, however, the fuel element does not include any central passageway, and has the appearance, when viewed along its longitudinal axis, essentially as is set forth in FIG. 8. In addition, the fuel element is provided by providing a mixture of about 73.5 parts milled carbon powder, about 10.5 parts graphite, about 5 parts milled low tobacco specific nitrosamine content tobacco burley lamina, about 10 parts guar gum; and about 1 part sodium carbonate.

Example 9

A cigarette of the general type described previously with reference to FIG. 1 is provided in the general manner set forth in Example 2. However, the cigarette has an overall length of about 90 mm. The smokable lighting end segment has a length of about 30 mm, the heat source segment has a length of about 10 mm, the aerosol-generation segment has a length of about 20 mm, and the filter element has a length of about 30 mm.

Example 10

A cigarette of the general type described previously with reference to FIG. 1 is provided in the general manner set forth in Example 2. However, half of the processed tobacco material within the aerosol-generation segment is replaced with a flavored tobacco material that is prepared as follows:

The processed tobacco material is provided by forming an aqueous slurry of about 6 parts ammonium alginate, about 54 parts glycerin, about 29 parts of a paper-type reconstituted tobacco manufactured from water extracted burley tobacco (and hence including essentially no water soluble extract portion), about 4 parts diammonium phosphate, about 3 parts of finely milled particles of burley tobacco lamina, and about 4 parts of a concentrated flavor package. The slurry is mixed and is cast as a sheet, and heat is applied to dry the cast slurry to a moisture content of about 12 to about 13 percent. During casting of the slurry, a top load of finely divided particles of burley tobacco lamina is applied to the sheet, such that the final sheet incorporates about 90 parts of the slurry components and about 10 parts of the milled burley tobacco lamina, on a dry weight basis.

Example 11

A cigarette of the general type described previously with reference to FIG. 1 is provided in the general manner set forth in Example 2. However, the fuel element of the heat generation segment is replaced with a fuel element that is provided as follows:

The carbonaceous fuel element is essentially of the type set forth in Example 1, and is provided using techniques and materials essentially of the type set forth in Example 1, however, the fuel element does not include any central passageway, and has the appearance, when viewed along its longitudinal axis, essentially as is set forth in FIG. 8. In addition, the fuel element is provided by providing a mixture of about 69.5 parts milled carbon powder, about 14.5 parts graphite, about 5 parts milled low tobacco specific nitrosamine content tobacco burley lamina, about 10 parts guar gum; and about 1 part sodium carbonate.

Example 12

A cigarette of the general type described previously with reference to FIG. 1 is provided in the general manner set forth in Example 2. However, the fuel element of the heat generation segment is replaced with a fuel element that is provided as follows:

The carbonaceous fuel element is essentially of the type set forth in Example 1, and is provided using techniques and materials essentially of the type set forth in Example 1, however, the fuel element does not include any central passageway, and has the appearance, when viewed along its longitudinal axis, essentially as is set forth in FIG. 8. In addition, the fuel element is provided by providing a mixture of about 65.5 parts milled carbon powder, about 18.5 parts graphite, about 5 parts milled low tobacco specific nitrosamine content tobacco burley lamina, about 10 parts guar gum; and about 1 part sodium carbonate. The density of such a fuel element so provided preferably is slightly less than that exhibited by the fuel element provided using the techniques and materials set forth in Example 1.

Example 13

A cigarette of the general type manufactured for commercial sale under the brand name "Eclipse" by R. J. Reynolds Tobacco Company is provided. However, the 12 mm carbonaceous fuel element is carefully removed from the cigarette and cut to a length of about 8 mm. The 8 mm segment is reinserted into the cigarette so as to abut the aerosol-generation segment 51. Into the resulting cylindrical cavity within the insulating member is inserted about 30 mg of tobacco cut filler of the type described in Example 1, such that the downstream end of the tobacco cut filler and the upstream end of the fuel element contact one another. As such, the smokable lighting end segment of the cigarette includes a 12 mm length of insulating member having a 4 mm length of tobacco cut filler at one end, and an 8 mm extruded carbonaceous segment at the other.

Example 14

A cigarette of the general type described with reference to Example 13 is provided. However, the 8 mm carbonaceous fuel element is replaced with fuel element having a length of 8 mm but which is provided in the manner set forth in Example 12.

Example 15

A cigarette of the general type described with reference to Example 12 is provided. However, rather than employing a smokable lighting end segment having a length of about 21 mm, a similar smokable lighting end segment having a length of about 15 mm is employed.

Example 16

A cigarette of the general type described with reference to Example 12 is provided. However, rather than employing a smokable lighting end segment having a length of about 21 mm, a similar smokable lighting end segment having a length of about 10 mm is employed.

Example 17

A cigarette of the general type described with reference to Example 1 is provided. However, rather than employing a smokable lighting end segment having a length of about 21 mm, a similar smokable lighting end segment having a length of about 8 mm is employed.

It is intended that the foregoing detailed description be regarded as illustrative rather than limiting, and that it be understood that it is the following claims, including all equivalents, that are intended to define the spirit and scope of this invention.

We claim:

1. A smoking article comprising:

a lighting end and a mouth end;

a smokable portion disposed at the lighting end, said smokable portion comprising a smokable material circumscribed by wrapping material;

a mouth end piece disposed at the mouth end; and an aerosol-generation system disposed between the smokable portion and the mouth end piece, the aerosol-generation system including (i) a heat generation portion adjacent to the lighting end portion and including a heat source, and (ii) an aerosol-generation portion incorporating aerosol-forming material, the aerosol-generation portion being disposed between the heat generation portion and the mouth end;

wherein the smokable portion is in a heat exchange relationship with the heat generation portion such that the smokable material is configured to, when ignited and at least partially burned, activate the heat source included by the heat generation portion;

wherein the heat source includes a lighting end side that substantially faces toward the lighting end and faces substantially opposite the mouth end; and wherein the smokable portion extends distally past, and substantially covers, the lighting end side of the heat source.

2. The smoking article of claim 1, said smoking article having a generally cylindrical shape and a longitudinal outer surface provided by wrapping material, the lighting end being open to expose the smokable material—said smokable material comprising tobacco in cut filler form, the aerosol-generation portion being physically separate from the heat generation portion and the mouth end being open to permit draw of an aerosol produced during use of the smoking article.

3. The smoking article of claim 1 wherein the mouth end piece comprises a filter element.

4. The smoking article of claim 1 wherein the aerosol-forming material includes glycerin.

5. The smoking article of claim 1 wherein the wrapping material comprises a paper composition.

6. The smoking article of claim 1 wherein essentially all of the smokable material consists essentially of tobacco in cut filler form.

7. The smoking article of claim 1 wherein the smokable portion has a length of about 5 mm to about 25 mm, the aerosol-generation system has a length of about 20 mm to about 50 mm, and the mouth end has a length of about 10 mm to about 40 mm.

8. The smoking article of claim 1 wherein the smokable portion has a length of about 5 mm to about 25 mm, the heat generation portion has a length of about 5 mm to about 30 mm, the aerosol-generation region has a length of about 10 mm to about 45 mm, and the mouth end piece has a length of about 10 mm to about 40 mm.

9. The smoking article of claim 1 wherein the heat source included by the heat generation portion comprises a combustible fuel element, activation of which requires ignition by the smokable material.

10. The smoking article of claim 1 wherein the heat generation portion is in a heat exchange relationship with the aerosol-generation portion such that heat generated in the heat generation portion acts to volatilize the aerosol-forming material within the aerosol-generation region.

11. The smoking article of claim 1 wherein the smokable portion incorporates tobacco material, and the smokable portion yields components of tobacco smoke when the smokable portion is burned.

12. The smoking article of claim 1 wherein the heat generation portion includes a carbonaceous fuel element.

13. The smoking article of claim 1 wherein the heat generation portion includes a carbonaceous fuel element circumscribed by insulation.

14. The smoking article of claim 1 wherein the heat generation portion includes a carbonaceous fuel element that is substantially solid.

15. The smoking article of claim 1 wherein the aerosol-generation portion comprises cut tobacco filler.

16. The smoking article of claim 1 wherein the aerosol-generation portion comprises a first region that includes at least one flavoring agent, and a second region that includes the aerosol-forming material.

17. A smoking article, comprising:

a lighting end portion;

a mouth end portion; and an intermediate portion between and connecting said end portions;

the lighting end portion comprising a smokable material;

the intermediate portion comprising a substantially solid combustible heat source adjacent the smokable material and an aerosol-forming material adjacent the mouth end portion;

wherein the heat source includes a lighting end side that substantially faces toward the lighting end and that faces substantially opposite the mouth end;

wherein the smokable material includes cut tobacco filler that extends distally past, and substantially covers, the lighting end side of the heat source; and wherein the lighting end portion is in a heat exchange relationship with the heat source such that the smokable material of the lighting end portion is configured to, when ignited and at least partially burned, ignite the heat source.

18. The smoking article of claim 17 wherein the heat source comprises a carbonaceous fuel element.

19. The smoking article of claim 17 wherein the heat source comprises a fuel element circumscribed by insulation.

20. A smoking article, comprising:

a smokable material;

an aerosol-releasing material; and an intermediate portion comprising a fuel element circumscribed by an insulative material, the intermediate portion being disposed longitudinally between and connecting the smokable material to the aerosol-releasing material;

wherein the smokable material includes cut tobacco filler that extends distally past, and substantially covers, at least a distal-facing side of the fuel element that faces substantially away from the aerosol-releasing material; and wherein the smokable material is in a heat exchange relationship with the fuel element such that the smokable material is configured to, when ignited and at least partially burned, ignite the fuel element.

* * * * *

UNITED STATES PATENT AND TRADEMARK OFFICE

CERTIFICATE OF CORRECTION

PATENT NO. : 7,647,932 B2
APPLICATION NO. : 11/194215
DATED : January 19, 2010
INVENTOR(S) : Cantrell et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1032 days.

Signed and Sealed this

Sixteenth Day of November, 2010

David J. Kappos

David J. Kappos
*Director of the United States Patent and Trademark Office*